US007282844B2

(12) United States Patent
Kanao et al.

(10) Patent No.: US 7,282,844 B2
(45) Date of Patent: Oct. 16, 2007

(54) HIGH PERFORMANCE, LONG-LIFE SPARK PLUG

(75) Inventors: Keiji Kanao, Aichi-ken (JP); Shinichi Okabe, Aichi-ken (JP)

(73) Assignees: Denso Corporation (JP); Nippon Soken, Inc. (JP)

( * ) Notice: Subject to any disclaimer, the term of this patent is extended or adjusted under 35 U.S.C. 154(b) by 451 days.

(21) Appl. No.: 10/937,374

(22) Filed: Sep. 10, 2004

(65) Prior Publication Data

US 2005/0057134 A1 Mar. 17, 2005

(30) Foreign Application Priority Data

Sep. 17, 2003 (JP) ..... 2003-324587

(51) Int. Cl.
*H01T 13/20* (2006.01)

(52) U.S. Cl. ..... 313/141; 313/118; 313/143

(58) Field of Classification Search ..... 313/118, 313/141–143

See application file for complete search history.

(56) References Cited

U.S. PATENT DOCUMENTS

| | | | | |
|---|---|---|---|---|
| 5,873,338 | A | 2/1999 | Matsubara et al. | 123/169 EL |
| 5,877,584 | A | 3/1999 | Kato et al. | 313/143 |
| 6,078,129 | A | 6/2000 | Gotou et al. | 313/141 |
| 6,147,441 | A | 11/2000 | Osamura | 313/141 |
| 6,831,397 | B2 | 12/2004 | Kanao et al. | 313/141 |
| 6,846,214 | B1 | 1/2005 | Gotou et al. | 445/7 |
| 2003/0085643 | A1 * | 5/2003 | Matsubara | 313/141 |
| 2005/0023949 | A1 * | 2/2005 | Hori | 313/141 |
| 2005/0029915 | A1 * | 2/2005 | Yorita et al. | 313/141 |
| 2005/0057133 | A1 * | 3/2005 | Hori | 313/141 |

FOREIGN PATENT DOCUMENTS

| | | | |
|---|---|---|---|
| EP | 0400950 B1 | | 2/2000 |
| JP | 60-235379 | | 11/1985 |
| JP | 60235379 A | * | 11/1985 |
| JP | 61-61390 | | 3/1986 |
| JP | 61061390 A | * | 3/1986 |
| JP | 3-1475 | | 1/1991 |

(Continued)

OTHER PUBLICATIONS

JPO Action dated Dec. 6, 2006.

*Primary Examiner*—Joseph Williams
*Assistant Examiner*—Kevin Quarterman
(74) *Attorney, Agent, or Firm*—Nixon & Vanderhye PC

(57) ABSTRACT

A spark plug includes a metal shell, an insulator, a center electrode, a ground electrode, a first noble metal chip, and a second noble metal chip. The metal shell has a threaded portion with an outer diameter of equal to or less than 14 mm for installing the spark plug to an internal combustion engine. The parameters in the structure of the spark plug, such as an end surface area S of the first noble metal chip, a length A of the first noble metal chip, an end surface area Q of the second noble metal chip, a length B of the second noble metal chip, an air pocket size L, a space G of a spark gap, a ratio L/G, and a thickness T of the insulator, have suitable dimensional ranges determined through experimental investigation. The structure ensures high performance and a long service life for the spark plug.

21 Claims, 15 Drawing Sheets

FOREIGN PATENT DOCUMENTS

| | | | | |
|---|---|---|---|---|
| JP | 9-219274 | | | 8/1997 |
| JP | 09219274 | A | * | 8/1997 |
| JP | 9-330782 | | | 12/1997 |
| JP | 10-41047 | | | 2/1998 |
| JP | 11-3765 | | | 1/1999 |
| JP | 2000-243535 | | | 9/2000 |
| JP | 2000243535 | A | * | 9/2000 |
| JP | 2002-313524 | | | 10/2002 |

* cited by examiner

HIGH PERFORMANCE, LONG-LIFE SPARK PLUG

BACKGROUND OF THE INVENTION

1. Technical Field of the Invention

The present invention relates generally to spark plugs for internal combustion engines. More particularly, the invention relates to an improved structure of a spark plug for an internal combustion engine of an automotive vehicle which ensures high performance and a long service life of the spark plug.

2. Description of the Related Art

Conventional spark plugs for use in internal combustion engines generally include a metal shell, an insulator, a center electrode, and a ground electrode.

The metal shell has a threaded portion for fitting the spark plug into a combustion chamber of the engine. The insulator has a center bore formed therein, and is fixed in the metal shell such that an end thereof protrudes from an end of the metal shell. The center electrode is secured in the center bore of the insulator such that an end thereof protrudes from the end of the insulator. The ground electrode has a side surface, and is joined to the end of the metal shell such that the side surface thereof is opposed to and spaced from the end of the center electrode so as to form a spark gap therebetween.

In recent years, an increase of compression ratios of internal combustion engines has been pursued for the purpose of increasing power output and improving fuel economies. However, at the same time, such an increase of compression ratio causes an increase of required spark voltage (i.e., the electric voltage required for sparking) of a spark plug.

The increased required spark voltage for the spark plug implies that it becomes difficult to generate sparks in the spark gap of the spark plug. Thus, instead of normal sparks being generated in the spark gap, "side sparks" can be generated.

The side spark is a spark which creeps from the center electrode of a spark plug along an outer surface of the insulator, and flies to the metal shell of the spark plug. More specifically, the side spark flies over the gap between the outer surface of the insulator and an inner surface of the metal shell, thus resulting in a misfire of the spark plug. Accordingly, when the side spark is generated, the performance of the engine employing the spark plug will drop.

On the other hand, in order to increase the power output of an internal combustion engine, it is generally required to increase the sizes of valves used in connection with the intake manifolds and exhaust manifolds for the engine and to secure a water jacket for the cooling of the engine. Consequently, the space available for installing a spark plug to the engine is decreased, and accordingly, it is desired to minimize the size of the spark plug.

The minimization of the spark plug results in a decreased size of an air pocket, which is the space between an outer surface of the insulator and an inner surface of the metal shell at the end of the metal shell to which the ground electrode is joined. The decreased size of air pocket can generate side sparks in the spark plug, in addition to an increase of required spark voltage for the spark plug as described above.

Therefore, it is required to keep the size of the air pocket in a spark plug above a certain level so as to prevent generation of side sparks. However, on the other hand, when the radial thickness of the insulator of the spark plug is sacrificed for keeping the size of the air pocket in minimization of the spark plug, the withstand voltage of the spark plug will be decreased; the decreased withstand voltage can cause a dielectric breakdown of the spark plug.

Accordingly, when minimizing a spark plug, there is a trade-off between preventing generation of side sparks in the spark plug and securing withstand voltage of the spark plug.

As a solution to such a trade-off, a spark plug is proposed in Japanese Unexamined Patent Publication No. 2000-243535, which has a structure with appropriately specified parameters such as the radial thickness of an insulator and the air pocket size in the spark plug as described above.

In addition to pursuing the high performance of internal combustion engines as described above, a long service life for those engines has also been pursued. For example, it was required to secure an actual mileage of about 100,000 km for an engine in the past; now, however, 200,000 km is required.

Under such circumstances, the inventors of the present invention have investigated the spark plug proposed in Japanese Unexamined Patent Publication No. 2000-243535. As a result, the inventors have found that when the spark plug is used over a long period of time, it is not possible to reliably eliminate side sparks in the spark plug.

Specifically, when the spark plug is used for a long period of time above 200,000 km, the center and ground electrodes of the spark plug will be considerably worn down, so that the spark gap therebetween is largely increased. Then, the required spark voltage of the spark plug is also increased due to the increased spark gap, thus facilitating generation of side sparks in the spark plug. Consequently, the structure of the spark plug is unable to secure a high performance and a long service life for the spark plug.

SUMMARY OF THE INVENTION

It is, therefore, an object of the present invention to provide a spark plug having an improved structure which prevents generation of side sparks in the spark plug without sacrificing withstand voltage of the spark plug, over a long service life.

As described previously, the spark gap in a conventional spark plug will increase considerably after a long running. The increased spark gap causes the required spark voltage of the spark plug to increase, thus facilitating generation of side sparks in the spark plug.

Therefore, it is required to suppress the increase of the required spark voltage of a spark plug due to increase of the spark gap of the same so as to impart high performance and a long service life to the spark plug.

A conventional approach for suppressing such increase of the required spark voltage of a spark plug is to strengthen the electric field in the spark gap of the spark plug through slenderizing the center electrode of the spark plug; a stronger electric field in the spark gap, especially around the center electrode, is more advantageous to suppressing the required spark voltage of the spark plug.

On the basis of the conventional approach, the inventors of the present invention have experimentally found that the electric field in the spark gap of the spark plug can be strengthened not only by slenderizing the center electrode of the spark plug but also by slenderizing and protruding the ground electrode of the same. In other words, the inventors have found that slenderizing and protruding the ground electrode of a spark plug has an effect on suppression of the increase of the required spark voltage thereof.

Furthermore, the inventors of the present invention have experimentally investigated suitable ranges of parameters in the structure of a spark plug where the ground electrode thereof is slenderized and protruded.

The present invention is based on the results of the experimental investigations.

According to one aspect of the present invention, a spark plug S1 is provided which includes:

a hollow metal shell having a first end and a second end opposed to the first end, the metal shell also having a threaded portion on an outer periphery thereof and an inner chamber opening at the first end, the threaded portion having an outer diameter in a range of 12 to 14 mm;

an insulator having a length with a first end and a second end opposed to the first end of the insulator, the insulator also having a bore formed therein, the insulator being fixed in the inner chamber of the metal shell such that the first end of the insulator protrudes from the first end of the metal shell;

a center electrode secured in the bore of the insulator, the center electrode having an end protruding from the first end of the insulator;

a ground electrode having a side surface, the ground electrode being joined to the first end of the metal shell such that the side surface of the ground electrode is in opposed relationship with the end of the center electrode;

a first noble metal chip having a first end joined to the end of the center electrode, and a second end facing the side surface of the ground electrode; and a second noble metal chip having a first end joined to the side surface of the ground electrode and a second end facing the second end of the first noble metal chip, the second end of the second noble metal chip being spaced from the second end of the first noble metal chip so as to form a spark gap therebetween;

wherein a surface area S of the second end of the first noble metal chip is in a range of 0.12 to 0.38 $mm^2$, inclusive;

a length A of the first noble metal chip from the end of the center electrode to the second end of the first noble metal chip is in a range of 0.8 to 1.5 mm, inclusive;

a surface area Q of the second end of the second noble metal chip is in a range of 0.12 to 0.65 $mm^2$, inclusive;

a length B of the second noble metal chip from the side surface of the ground electrode to the second end of the second noble metal chip is in a range of 0.5 to 1.2 mm, inclusive;

a distance L between an inner surface of the metal shell defining the inner chamber and an outer surface of the insulator on a reference plane which extends perpendicular to the length of the insulator through an inner edge of the first end of the metal shell, is equal to or greater than 1.5 mm;

a ratio L/G of the distance L to a space G of the spark gap between the second ends of the first and second noble metal chips is equal to or greater than 1.25; and a thickness T of the insulator on the reference plane is equal to or greater than 0.7 mm.

The dimensional ranges of the parameters S, A, Q, and B have been respectively specified, as described above, thereby strengthening the electric field in the spark gap of the spark plug S1.

Further, strengthening the electric field in the spark gap, the increase of required spark voltage of the spark plug S1 due to increase of the space G of the spark gap can be considerably suppressed in comparison with conventional spark plugs.

Furthermore, the dimensional ranges of the distance L together with the ratio L/G, and the thickness T have been respectively specified, as described above, so that generation of side sparks in the spark plug S1 can be effectively suppressed while securing the insulation performance (i.e., the withstand voltage) of the spark plug S1.

Accordingly, the spark plug S1 according to the present invention has a structure which prevents generation of side sparks in the spark plug, while securing the withstand voltage thereof, over a long service life.

As described previously, the spark plug S1 includes the metal shell having the threaded portion with an outer diameter in the range of 12 to 14 mm.

Compared to the above spark plug S1, a spark plug S2 which includes a metal shell having a threaded portion with an outer diameter of equal to less than 10 mm, is more slenderized. Therefore, although the spark plug S2 has a structure almost identical to that of the spark plug S1, parameters in the structure of the spark plug S2, such as the distance L and the thickness T, cannot have the same dimensional ranges as described above due to dimensional constraints.

According to another aspect of the present invention, dimensional ranges of parameters in the structure of the spark plug S2 which includes the metal shell having the threaded portion with an outer diameter of equal to less than 10 mm, have thus been specified as follows:

a surface area S of a second end of a first noble metal chip is in a range of 0.12 to 0.38 $mm^2$, inclusive;

a length A of the first noble metal chip from an end of a center electrode to the second end of the first noble metal chip is in a range of 0.8 to 1.5 mm, inclusive;

a surface area Q of a second end of a second noble metal chip is in a range of 0.12 to 0.65 $mm^2$, inclusive;

a length B of the second noble metal chip from a side surface of a ground electrode to the second end of the second noble metal chip is in a range of 0.5 to 1.2 mm, inclusive;

a distance L between an inner surface of the metal shell defining an inner chamber of the same and an outer surface of an insulator on a reference plane which extends perpendicular to a length of the insulator through an inner edge of a first end of the metal shell, is in a range of 1.2 to 1.6 mm, inclusive;

a space G of a spark gap between the second ends of the first and second noble metal chips is in a range of 0.4 to 1.0 mm, inclusive; and a thickness T of the insulator on the reference plane is in a range of 0.5 to 0.8 mm, inclusive.

In the structure of the spark plug S2, the parameters S, A, Q, and B have, respectively, the same dimensional ranges as in the structure of the spark plug S1, so that the electric field in the spark gap of the spark plug S2 can be strengthened. Consequently, the increase of required spark voltage due to increase of the space G of the spark gap can be considerably suppressed in comparison with conventional spark plugs.

Moreover, through specifying the dimensional range of the distance L as described above, generation of side sparks can be effectively suppressed under the dimensional constraints in the structure of the slenderized spark plug S2.

Further, through specifying the dimensional range of the space G of the spark gap as described above, misfires can be prevented in the slenderized spark plug S2, thereby enhancing the ignition performance of the spark plug S2.

Furthermore, through specifying the dimensional range of the thickness T as described above, the insulation performance (i.e., the withstand voltage) of the spark plug S2 can be secured under the dimensional constraints in the structure of the slenderized spark plug S2.

Accordingly, the spark plug S2 according to the present invention also has a structure which prevents generation of side sparks in the spark plug, while securing the withstand voltage thereof, over a long service life.

According to a preferred embodiment of the present invention, in the structure of the spark plug S2, a clearance L1 between an inner surface of the insulator and an outer surface of the center electrode on a plane which extends parallel to the reference plane through an inner edge of the first end of the insulator, is greater than 0.1 mm, and equal to or less than 0.3 mm.

Through specifying the dimensional range of the clearance L1, the spark plug S2 can be imparted further enhanced capability in suppressing generation of side sparks therein.

According to another preferred embodiment of the present invention, in the structure of the spark plug S2, either the inner or the outer surface of the insulator includes a small diameter section and a frusto-conical section. Further, the range of a taper degree of the frusto-conical section has been specified such that the taper degree is less than 2, preferably equal to or less than 1.5.

Through specifying the range of the taper degree of the frusto-conical section, the thermal strength of the insulator of the spark plug S2 can be secured, thereby avoiding occurrence of cracks in the insulator without sacrificing the insulation performance of the spark plug S2.

According to yet another preferred embodiment of the present invention, in the structures of the spark plug S1 and spark plug S2, the first noble metal chips are made of an Ir-based alloy including Ir in an amount of greater than 50 weight percent and at least one additive; the alloy has a melting point of greater than 2000 degrees Celsius. Furthermore, at least one additive is preferably selected from Pt, Rh, Ni, W, Pd, Ru, Re, Al, $Al_2O_3$, Y, $Y_2O_3$.

Moreover, the second noble metal chips are made of a Pt-based alloy including Pt in an amount of greater than 50 weight percent and at least one additive; that alloy has a melting point of greater than 1500 degrees Celsius. Furthermore, at least one additive for the second noble metal chips is preferably selected from Ir, Rh, Ni, W, Pd, Ru, Re.

Through specifying the materials of the first and second noble metal chips for the spark plugs S1 and S2, a long service life can be secured for those first and second noble metal chips.

BRIEF DESCRIPTION OF THE DRAWINGS

The present invention will be understood more fully from the detailed description given hereinafter and from the accompanying drawings of the preferred embodiments of the invention, which, however, should not be taken to limit the invention to the specific embodiments but are for the purpose of explanation and understanding only.

In the accompanying drawings.

DESCRIPTION OF THE PREFERRED EMBODIMENTS

Figure 1:
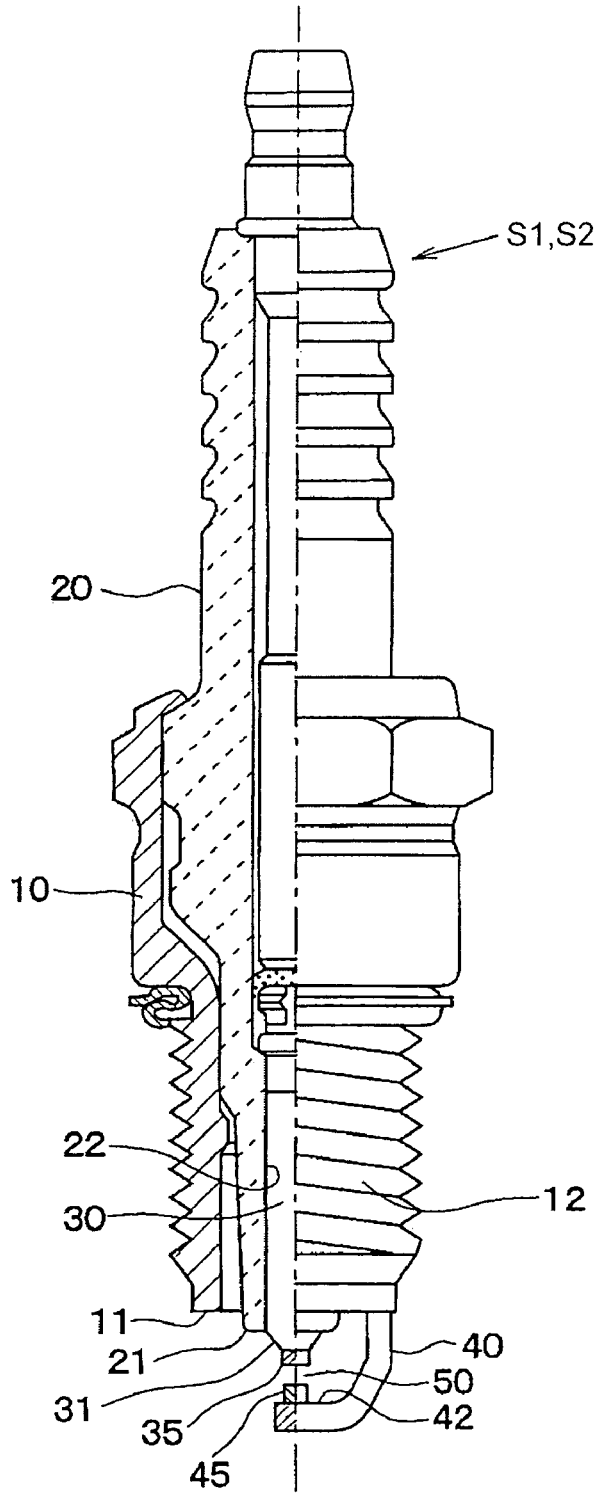
FIG. 1 is a partially cross-sectional side view showing an overall structure of a spark plug according to a first embodiment of the invention.

The preferred embodiments of the present invention will be described hereinafter with reference to FIGS. 1-14.

It should be noted that, for the sake of clarity and understanding, identical components having identical functions in different embodiments of the invention have been marked, where possible, with the same reference numerals in each of the figures.

First Embodiment

FIG. 1 shows an overall structure of a spark plug S1 according to a first embodiment of the invention.

The spark plug S1 is designed to be used for internal combustion engines of automotive vehicles. When installing the spark plug S1 to an internal combustion engine, it is inserted into a combustion chamber (not shown) of the engine through a threaded opening provided in the engine head (not shown) which forms the combustion chamber together with other components of the engine such as a cylinder and a piston.

As shown in FIG. 1, the spark plug S1 includes a metal shell 10, an insulator 20, a center electrode 30, a ground electrode 40, a first noble metal chip 35, and a second noble metal chip 45.

The hollow metal shell 10 is made of a conductive metal material, for example low-carbon steel. The metal shell 10 has a threaded portion 12 on the outer periphery thereof for fitting the spark plug S1 into a combustion chamber (not shown) of an engine as described above.

In this embodiment, the threaded portion 12 of the metal shell 10 has an outer diameter in the range of 12 to 14 mm, inclusive. This range corresponds to the range of M12 to M14 in accordance with JIS (Japanese Industrial Standards).

The tubular insulator 20, which is made of alumina ceramic ($Al_2O_3$), is fixed and partially contained in the metal shell 10 such that an end 21 of the insulator 20 protrudes from an end 11 of the metal shell 10.

Further, as seen from FIG. 1, an air pocket is formed between a lower portion of an inner surface of the metal shell 10 and a lower portion of an outer surface of the insulator 20. In the air pocket, the distance between the inner surface of the metal shell 10 and the outer surface of the insulator 20 decreases from a lower edge of the inner surface of the metal shell 10 to the interior of the air pocket.

The cylindrical center electrode 30 is made of a highly heat conductive metal material such as Cu as the core material and a highly heat-resistant, corrosion-resistant metal material such as a Ni (Nickel)-based alloy as the clad material.

The center electrode 30 is secured in a center bore 22 of the insulator 20, so that it is isolated from the metal shell 10. The center electrode 30 is partially included within the metal shell 10 together with the insulator 20 such that an end 31 of the center electrode 30 protrudes form the end 21 of the insulator 20.

The ground electrode 40, which is made of a Ni-based alloy consisting mainly of Ni, is column-shaped, for example an approximately L-shaped prism in this embodiment.

The ground electrode 40 has one end portion joined, for example by welding, to the end 11 of the metal shell 10. The other end portion of the ground electrode 40 has a side surface 42 that is opposed to the end 31 of the center electrode 30.

Figure 2:
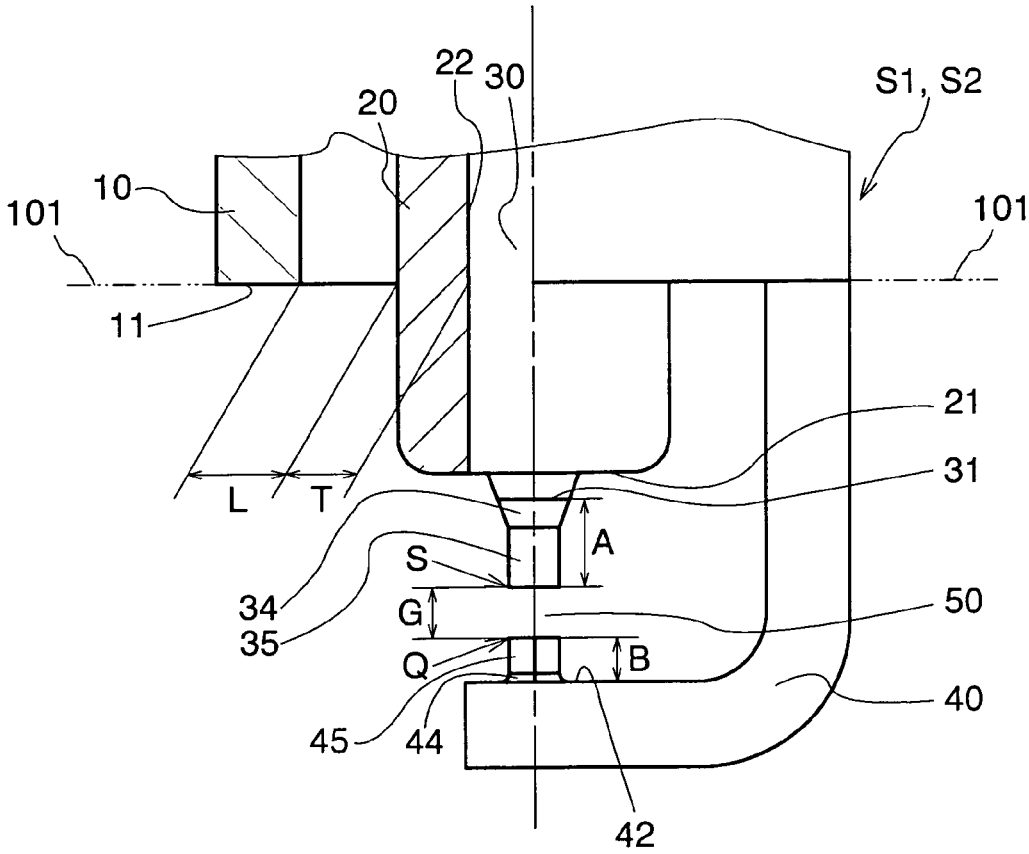
FIG. 2 is an enlarged partially cross-sectional side view showing a spark gap and the proximity thereof in the spark plug of FIG. 1.

Referring now to FIG. 2, the cylindrical first noble metal chip 35 has a first end joined to the end 31 of the center electrode and a second end facing the side surface 42 of the ground electrode 40.

In this embodiment, the first noble metal chip 35 is joined to the end 31 of the center electrode 30 by laser welding. Accordingly, there is a weld layer 34 formed between the first noble metal chip 35 and the center electrode 30 through melting and mixing of the two members in the laser welding.

The first noble metal chip 35 is preferably made of an Ir (Iridium)-based alloy including Ir in an amount of greater than 50 weight percent and at least one additive; the melting point of the alloy is greater than 2000 degrees Celsius.

Furthermore, at least one additive is preferably selected from Pt (Platinum), Rh (Rhodium), Ni, W (Tungsten), Pd (Palladium), Ru (Ruthenium), Re (Rhenium), Al (Aluminum), $Al_2O_3$ (Alumina), Y (Yttrium), $Y_2O_3$ (Yttria).

On the other hand, the cylindrical second noble metal chip 45 has a first end joined to the side surface 42 of the ground electrode 40 and a second end facing the second end of the first noble metal chip 35.

The two second ends of the first and second noble metal chips 35 and 45 are spaced from each other so as to form a spark gap 50 therebetween. The spark gap 50 has a space of, for example, 1 mm.

In this embodiment, the second noble metal chip 45 is joined to the side surface 42 of the ground electrode 40 by laser welding, so that a weld layer 44 is formed therebetween through melting and mixing thereof in the laser welding.

The second noble metal chip 45 is preferably made of a Pt-based alloy including Pt in an amount of greater than 50 weight percent and at least one additive; the melting point of the Pt-based alloy is greater than 1500 degrees Celsius.

Furthermore, at least one additive for the second noble metal chip 45 is preferably selected from Ir, Rh, Ni, W, Pd, Ru, Re.

It is necessary to note that other joining means may also be used to join the first and second noble metal chips 35 and 45 to the center and ground electrodes 30 and 40 respectively, such as resistance welding, plasma welding, and adhesive joining. Moreover, the two noble metal chips 35 and 45, which have cylindrical shapes in this embodiment, may also have prismatic shapes.

Having described all the essential components of the spark plug S1, the parameters designated as S, A, Q, B, G, L, T in FIG. 2 will be defined and described hereinafter. Those parameters are critical to the structure of the spark plug S1.

S is the surface area of the second end of the first noble metal chip 35 (referred to as end surface area S hereinafter).

A is the length of the first noble metal chip 35 from the end 31 of the center electrode 30 to the second end of the first noble metal chip 35 (referred to as length A hereinafter).

Q is the surface area of the second end of the second noble metal chip 45 (referred to as end surface area Q hereinafter).

B is the length of the second noble metal chip 45 from the side surface 42 of the ground electrode 40 to the second end of the second noble metal chip 45 (referred to as length B hereinafter).

G is the space between the two second ends of the first and second noble metal chips 35 and 45 (referred to as spark gap size G hereinafter).

L is the distance between the inner surface of the metal shell 10 and the outer surface of the insulator 20 on a reference plane 101 as shown in FIG. 2 (referred to as air pocket size L hereinafter); the reference plane 101 extends perpendicular to the longitudinal direction of the insulator 20 through the inner edge of the end 11 of the metal shell 10;

T is the thickness of the insulator 20 on the reference plane (referred to as insulation thickness T hereinafter).

Additionally, as described above, the first and second noble metal chips 35 and 45 are joined to the center and ground electrodes 30 and 40, respectively, by laser welding in this embodiment. In such cases, the length A of the first noble metal chip 35 includes the thickness of the weld layer 34, while the length B of the second noble metal chip 45 includes the thickness of the weld layer 44. In other cases where weld layers such as the weld layers 34 and 44 do not exist, the lengths A and B are only equal to the distance between the first and second ends of the first noble metal chip 35 and that of the second noble metal chip 45 respectively.

The dimensional ranges of the above parameters, which characterize the structure of the spark plug S1 according to the present embodiment, have been determined based on the investigation results from the inventors as follows.

First, the end surface area S and the length A of the first noble metal chip 35 have been considered in accordance with a conventional approach which slenderizes the center electrode of a spark plug to strengthen the electric field in the spark gap of the spark plug. More specifically, a smaller end surface area S and/or a greater length A are more advantageous to strengthening the electric field in the spark gap.

As mentioned previously, the first noble metal chip 35 has a cylindrical shape in this embodiment. It has been experimentally found that, when the surface diameter of the second end of the first noble metal chip 35 is equal to or less than 0.7 mm and the length A is equal to or greater than 0.8 mm, the electric field in the spark gap 50 of the spark plug S1 can be strengthened.

Further, it has also been experimentally found that, when the surface diameter of the second end of the first noble metal chip 35 is less than 0.4 mm or the length A is greater than 1.5 mm, it becomes difficult to transfer heat away from the first noble metal chip 35. Consequently, the spark erosion of the first noble metal chip 35 is increased due to the increased temperature thereof, so that it becomes impossible to secure a long service life for the first noble metal chip 35.

Furthermore, it is easy to understand that the surface diameter of 0.4 mm of the second end of the cylindrical first noble metal chip 35 is corresponding to a surface area of 0.12 $mm^2$ of the same, while the surface diameter of 0.7 mm is corresponding to a surface area of 0.38 $mm^2$. Additionally, it should be noted that the shape of the first noble metal chip 35 is not limited to being cylindrical.

Accordingly, in this embodiment, the dimensional ranges of the end surface area S and the length A of the first noble metal chip 35 have been specified to strengthen the electric field in the spark gap 50 such that S is in the range of 0.12 to 0.38 $mm^2$, and A is in the rage of 0.8 to 1.5 mm.

Secondly, the end surface area Q and the length B of the second noble metal chip 45 have been considered based on an approach that is originally proposed by the inventors to strengthen the electric field in the spark gap of a spark plug. The main idea of the approach is that the electric field in the spark gap of a spark plug can also be strengthened by slenderizing and protruding the ground electrode of the spark plug. Accordingly, for the second noble metal chip 45 of the spark plug S1, a smaller end surface area Q and/or a greater length B are more advantageous to strengthening the electric field in the spark gap 50.

In light of the above considerations, a spark plug structure, which is suitable for slenderizing the second noble metal chip 45 to strengthen the electric field in the spark gap 50, has been investigated; in the investigated structure, the metal shell 10 has the threaded portion 12 with an outer diameter in the range of 12 to 14 mm.

It should be noted that the investigation results to be shown below are particularly for the spark plug S1 where the outer diameter of the threaded portion 12 of the metal shell 10 is 14 mm; it has been, however, experimentally confirmed that the same tendency and similar results can be observed with any spark plug S1 where the outer diameter are in the range of 12 to 14 mm.

In addition, all the spark plugs used in the investigation had an end surface area S of 0.2 $mm^2$ and a length A of 1.2 mm for the first noble metal chip 35, and a reference spark gap size G of 1.0 mm. The end surface area S of 0.2 $mm^2$ was implemented by specifying the surface diameter of the second end of the cylindrical first noble metal chip 35 as 0.5 mm.

Two different types of spark plugs were used for the investigation; one type had no second noble metal chip 45 joined to the ground electrode 40 (referred to as flat ground type), while the other type had a second noble metal chip 45 joined to the ground electrode 40 (referred to as protruding ground type).

Accordingly, the flat ground type had a spark gap 50 formed between the second end surface of the first noble metal chip 35 and the side surface 42 of the ground electrode 40. For the protruding ground type, the second noble metal chip 45 had an end surface area Q of 0.38 $mm^2$ and a length B of 0.8 mm. The end surface area Q of 0.38 $mm^2$ was implemented by specifying the surface diameter of the second end of the cylindrical second noble metal chip 45 as 0.7 mm.

Using those two different types of spark plugs, the effect of employing the second noble metal chip 45 (i.e., the effect of slenderizing and protruding the ground electrode 40) on strengthening the electric field in the spark gap has been investigated through FEM (Finite Element Method) analysis.

Figure 3:
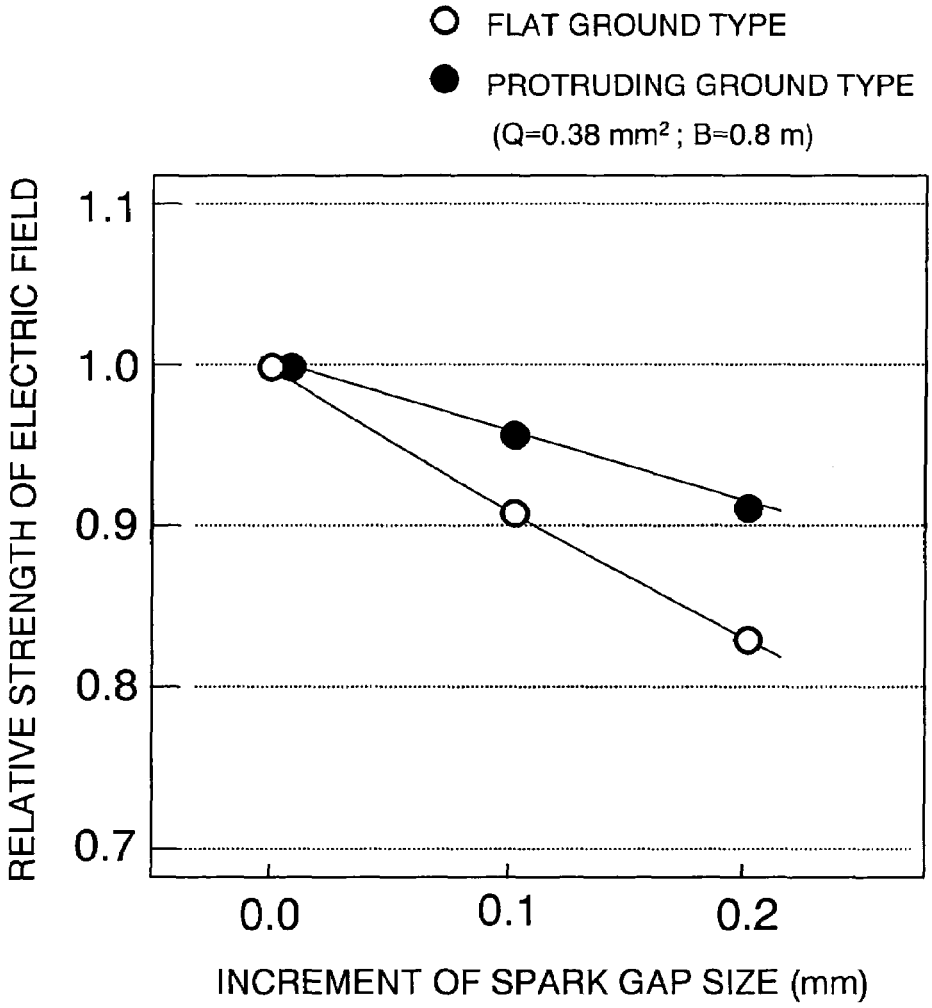
FIG. 3 is a graphical representation showing investigation results on the effect of employing a noble metal chip joined to a ground electrode of a spark plug on strengthening the electric field in a spark gap of the spark plug in connection with the first embodiment of the invention.

The investigation results are shown in FIG. 3, where the horizontal axis represents increment of the spark gap size G with respect to the reference spark gap size G of 1.0 mm, while the vertical axis represents the relative strength of the electric field.

The relative strength of the electric field is defined, for a given spark gap size G, as the ratio of the maximum strength of the electric filed in the spark gap 50 to a reference strength; the reference strength is the maximum strength of the electric field in the spark gap 50 when the spark gap size G is equal to the reference spark gap size G of 1.0 mm.

The investigation results shown in FIG. 3 reveal that, in the case of the protruding ground type, the relative strength of the electric filed decreases more slowly with respect to the increase of spark gap size G, in other words, the required spark voltage of the spark plug increases more slowly with respect to the increase of spark gap size G in comparison with the case of flat ground type.

It should be noted that a 0.2 mm increment of the spark gap size G approximately corresponds to the increment of the spark gap size G due to spark wear after an actual mileage of 200,000 km.

As can be seen from FIG. 3, in the case of the protruding ground type, even when the spark gap size G is increased by 0.2 mm, the relative strength of the electric field is kept above 0.9, which is acceptable in practical use.

Consequently, comparing to the conventional flat ground type, the protruding ground type according to the present embodiment can keep the electric field in the spark gap at a high level for a longer service life, thereby effectively suppressing any increase in the required spark voltage of the spark plug.

A further investigation has been directed to the end surface area Q and the length B of the second noble metal chip 45. Specifically, those dimensional ranges of the parameters Q and B, which can effectively suppress the increase of required spark voltage due to an increase of spark gap size G, have been determined through FEM analysis.

Figure 4A:
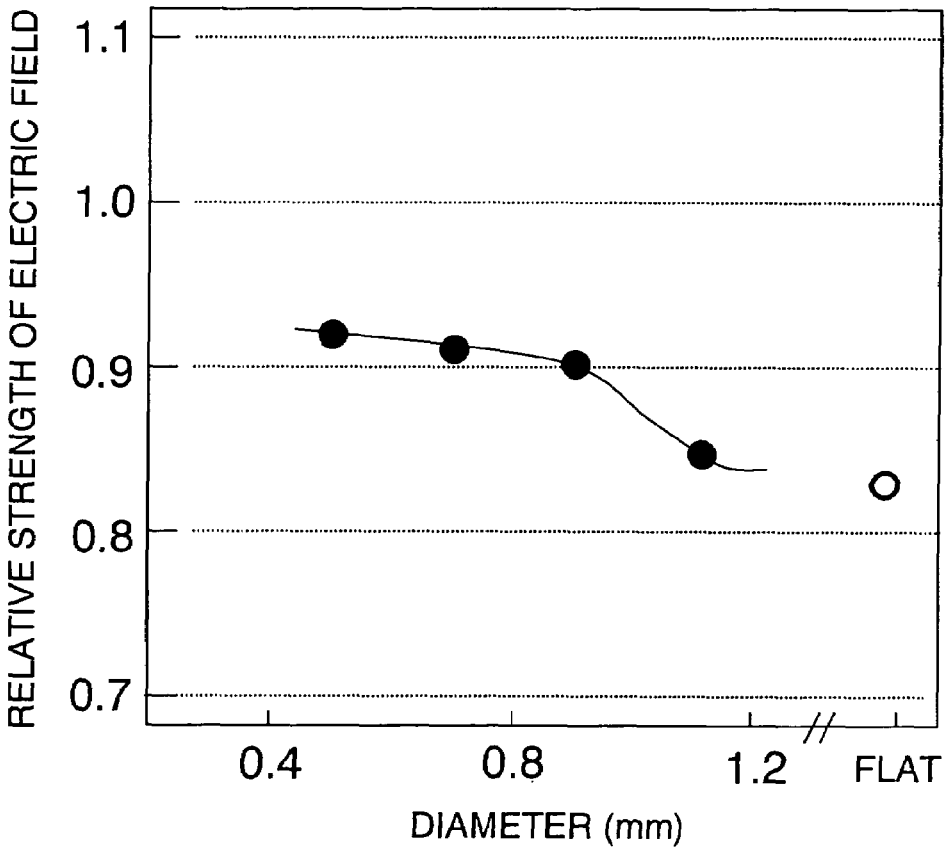
FIG. 4A is a graphical representation showing investigation results on the relationship between the diameter of an end surface of a noble metal chip on a ground electrode of a spark plug and the relative strength of electric field in a spark gap of the spark plug in connection with the first embodiment of the invention.
Figure 4B:
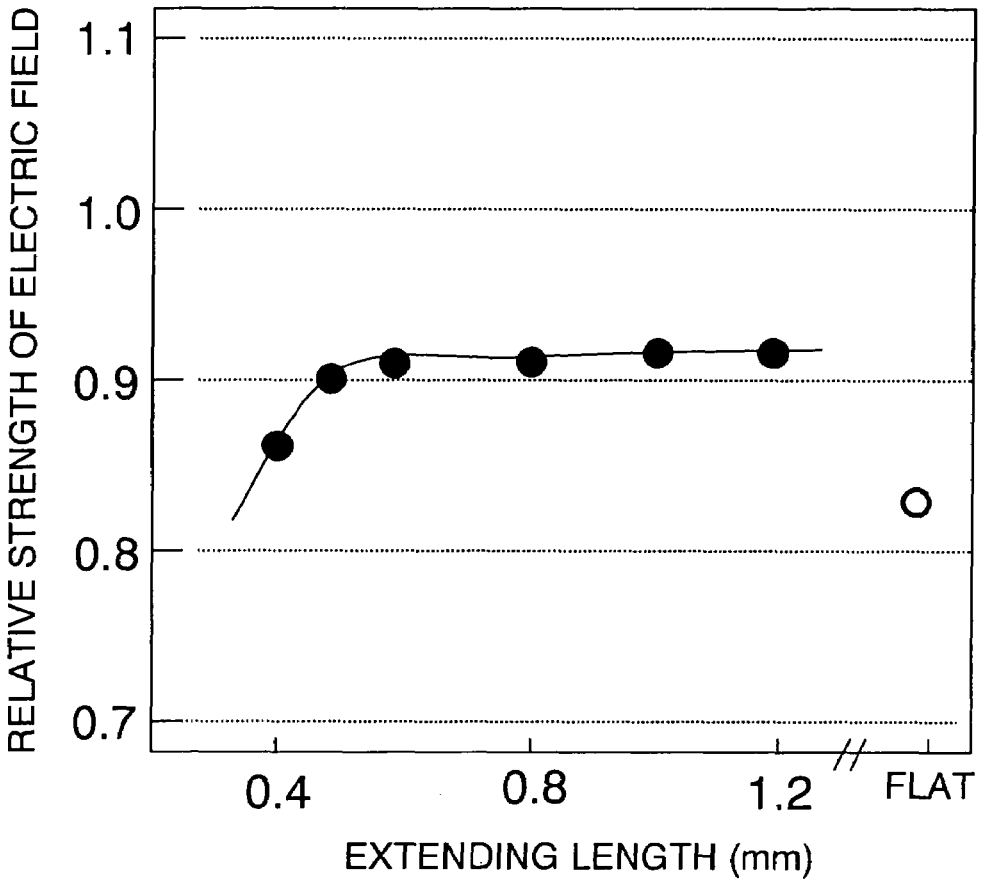
FIG. 4B is a graphical representation showing investigation results on the relationship between a length of a noble metal chip on a ground electrode of a spark plug and the relative strength of the electric field in a spark gap of the spark plug in connection with the first embodiment of the invention.

The investigation results are shown in FIGS. 4A and 4B. It should be noted that the second noble metal chips 45 of the spark plugs tested in the investigation had a cylindrical shape, and the spark gap sizes G thereof were kept constant at 1.2 mm.

The sizes of the second end surfaces of the second noble metal chips 45 are represented by diameter rather than area in FIG. 4A. Furthermore, in FIGS. 4A and 4B, the relative strength of the electric field has the same definition as in FIG. 3. In addition, black circle plots designate the results with the protruding ground type according to the present embodiment, while white circle plots designate the results with the conventional flat ground type for the purpose of comparison.

FIG. 4A shows investigation results, where the surface diameter of the second end of the second noble metal chip 45 was varied to determine the resultant relative strength of the electric field, while the length B was kept constant at 0.8 mm.

FIG. 4B shows investigation results, where the length B was varied to determine the resultant relative strength of the electric field, while the surface diameter of the second end of the second noble metal chip 45 was kept constant at 0.7 mm.

It can be seen from FIG. 4A and FIG. 4B that, when the surface diameter of the second end of the second noble metal chip 45 is equal to or less than 0.9 mm and the length B is equal to or greater than 0.5 mm, the relative strength of the electric field can be kept above 0.9, thereby effectively suppressing the increase of required spark voltage due to increase of the spark gap size G.

Further, although not shown in the figures, it has been experimentally found that, when the surface diameter of the second end of the second noble metal chip 45 is less than 0.4 mm or the length B is greater than 1.2 mm, it becomes difficult to transfer heat away from the noble metal chip 45, resulting in a pre-ignition.

It is easy to understand that the surface diameter of 0.4 mm of the second end of the cylindrical second noble metal chip 45 is corresponding to a surface area of 0.12 $mm^2$ of the same, while the surface diameter of 0.9 mm is corresponding to a surface area of 0.65 $mm^2$. Additionally, it should be noted that the shape of the second noble metal chip 45 is not limited to being cylindrical.

Accordingly, in this embodiment, the dimensional ranges of the end surface area Q and the length B of the second noble metal chip 45 have been specified to strengthen the electric field in the spark gap 50 such that Q is in the range of 0.12 to 0.65 $mm^2$, and B is in the rage of 0.5 to 1.2 mm.

Specifying the ranges of the end surface area Q and the length B as well as the ranges of the end surface area S and the length A as described above, in the spark plug S1 which includes the threaded portion 12 with an outer diameter of 14 mm, the increase of required spark voltage due to an increased spark gap size G will be suppressed, thereby preventing the generation of side sparks.

Finally, the air pocket size L and the insulation thickness T have been considered for the spark plug S1.

The air pocket size L is a parameter which has an influence on the capability of the spark plug S1 in suppressing generation of side sparks. As described previously, since side sparks fly over the air pocket to the metal shell 10, a greater air pocket size L is more advantageous to suppressing generation of side sparks. Therefore, only a lower limit of the parameter L has been determined through an investigation to be described below.

Figure 5:
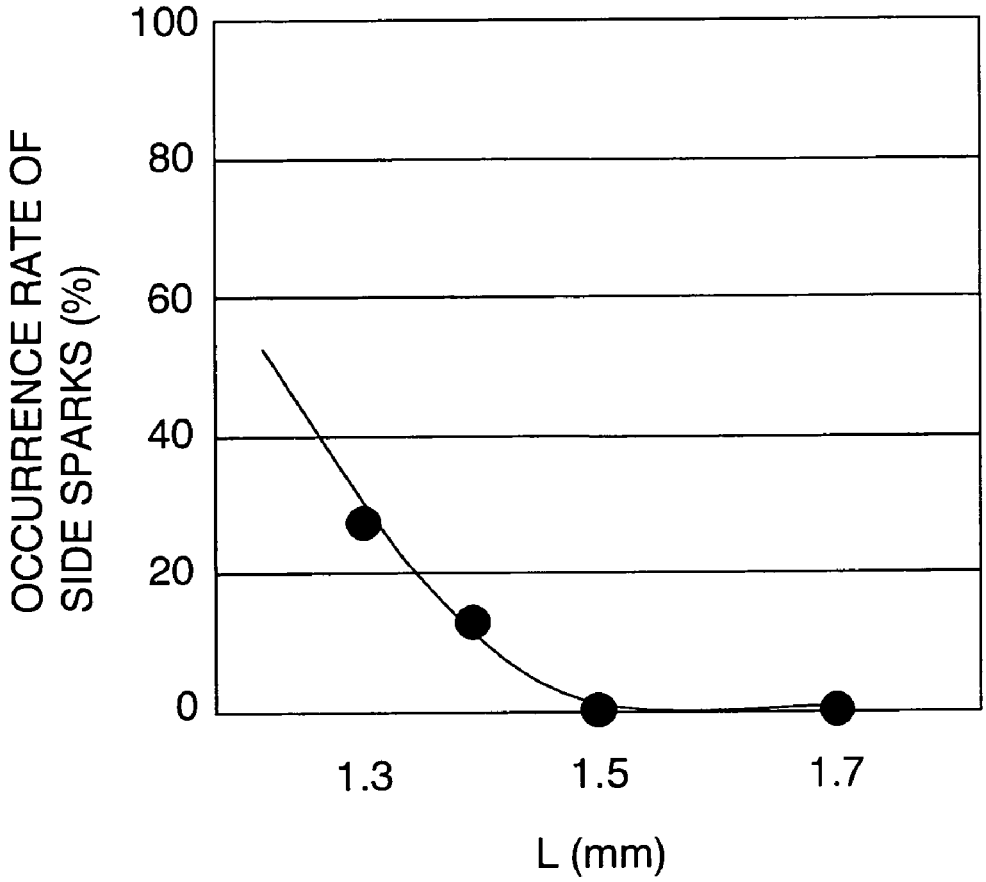
FIG. 5 is a graphical representation showing investigation results on the relationship between an air pocket size in a spark plug and the occurrence rate of "side sparks" in the spark plug in connection with the first embodiment of the invention.

FIG. 5 shows the investigation results on the relationship between the air pocket size L and the occurrence rate of side sparks (i.e., the probability of occurrence of side sparks). The investigation was conducted using a four-cylinder, 1800 cc engine under an idling condition where the engine speed is 800 rpm, and the water temperature is 50 degrees Celsius.

Spark plugs tested in the investigation had a structure in which the outer diameter of the threaded portion 12 is 14 mm; the end surface area S is 0.2 $mm^2$ (corresponding to an end surface diameter of 0.5 mm); the length A is 1.2 mm; the end surface area Q is 0.38 $mm^2$ (corresponding to an end surface diameter of 0.5 mm); the length B is 0.8 mm; and the spark gap size G is 1.2 mm.

In the investigation, the air pocket size L was varied to determine the resultant occurrence rate of side sparks. Specifically, for each given air pocket size L, a total of 100 times sparking were made, and the number of the sparking where side sparks had occurred was counted as the occurrence rate of side sparks for that given air pocket size L.

It can be seen from FIG. 5 that, when the air pocket size L is equal to or greater than 1.5 mm, generation of side sparks in the spark plug is completely suppressed.

In addition, generation of side sparks is influenced not only by the individual parameter L but also by the relationship between the parameter L and the spark gap size G. Specifically, when the air pocket size L is sufficiently large with respect to a given spark gap size G, only normal sparks are generated in the spark gap 50 while generation of side sparks is suppressed.

Therefore, in addition to considering the air pocket size L individually, the ratio of the air pocket size L to the spark gap size G (referred to as L/G hereinafter) has been considered. Since a greater L/G is more advantageous to suppressing generation of side sparks, only a lower limit of L/G has been determined using the lower limit of the air pocket size L (i.e., 1.5 mm) and the spark gap size G (i.e., 1.2 mm) in the above investigation such that L/G is equal to or greater than 1.25.

On the other hand, the insulation thickness T is a parameter which influences the capability of the spark plug S1 in preventing dielectric breakdown thereof (i.e., securing withstand voltage of the spark plug S1). A greater insulation thickness T is more advantageous to securing withstand voltage of the spark plug S1. Therefore, there is a trade-off between selecting greater insulation thickness T and selecting greater air pocket size L under dimensional constraints for the spark plug S1.

To prevent dielectric breakdown of the spark plug S1 while suppressing generation of side sparks therein, a lower limit of the insulation thickness T has been determined through an investigation.

Figure 6:
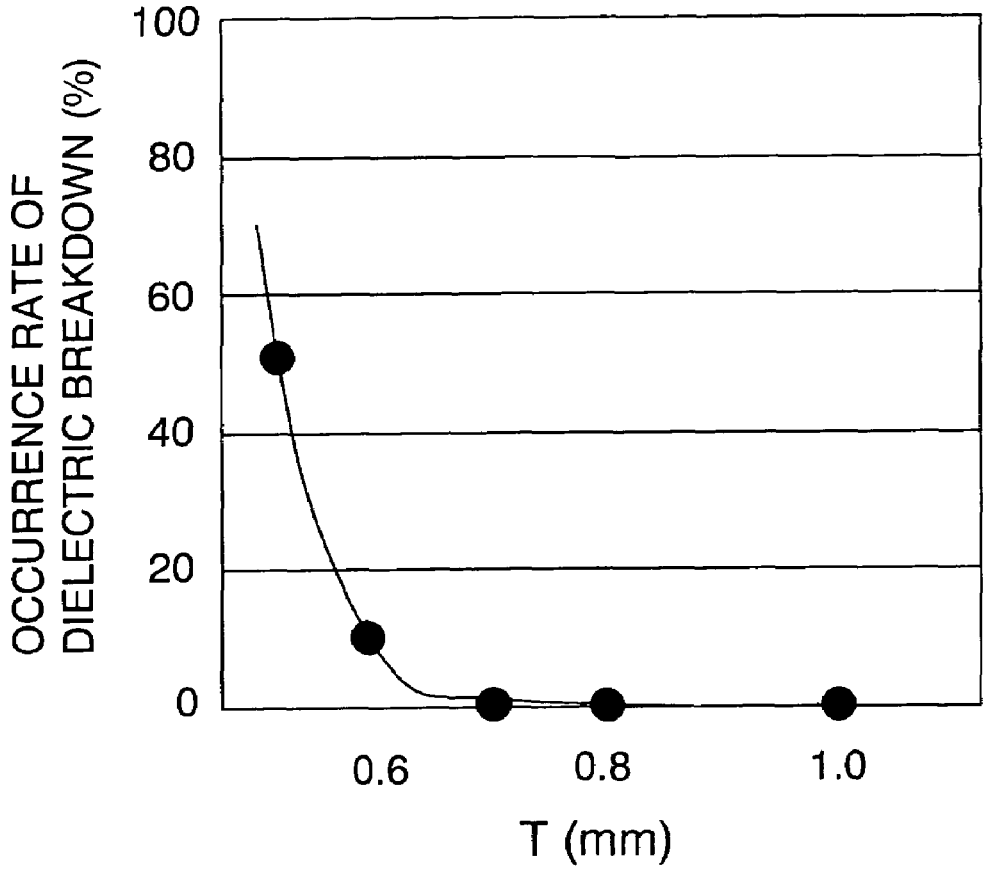
FIG. 6 is a graphical representation showing investigation results on the relationship between a thickness of an insulator of a spark plug and the occurrence rate of dielectric breakdown of the spark plug in connection with the first embodiment of the invention.

FIG. 6 shows the investigation results on the relationship between the insulation thickness T and the occurrence rate of dielectric breakdown of the spark plug. The investigation was conducted using a four-cylinder, 1800 cc engine under a condition of from idling to a full throttle acceleration of 1000 rpm; in that condition, required spark voltage is high and accordingly it is easy for dielectric breakdown of the spark plug to occur.

Spark plugs tested in the investigation had a structure in which the outer diameter of the threaded portion 12 is 14 mm; the end surface area S is 0.2 $mm^2$; the protruding length A is 1.2 mm; the end surface area Q is 0.38 $mm^2$; the protruding length B is 0.6 mm; the spark gap size G 1.2 mm; and the air pocket size L is 1.5 mm.

It should be noted that, when the air pocket size L decreases, the electric field in the spark plug is more concentrated on the portion of the insulator 20 on the reference plane 101 Therefore, the lower limit of the air pocket size L of 1.5 mm was used in the investigation in order to conduct that investigation under the most critical condition.

In the investigation, the insulation thickness T was varied to determine the resultant occurrence rate of dielectric breakdown of the spark plug. Specifically, for each given insulation thickness T, ten spark plugs with that given insulation thickness T were tested, and the ratio of the number of the spark plugs where dielectric breakdown had occurred to the total number of ten was counted as the occurrence rate of dielectric breakdown for that given insulation thickness T.

It can be seen from FIG. 6 that, when the insulation thickness T of the insulator 20 is equal to or greater than 0.7 mm, the withstand voltage of the spark plug is secured, thereby preventing dielectric breakdown thereof.

Accordingly, for the spark plug S1, since the insulation thickness T of the insulator 20 can be reduced to a considerably small size such as 0.7 mm, the air pocket size L can be correspondingly increased, thereby providing more flexibility to the design of the spark plug S1.

To sum up, the spark plug S1 according to the present embodiment, which includes the metal shell 10 having the threaded portion 12 with an outer diameter in the rage of 12 to 14 mm, has a structure characterized by the following parameters:

the end surface area S of the first noble metal chip 35 in the range of 0.12 to 0.38 $mm^2$;

the length A of the first noble metal chip 35 in the range of 0.8 to 1.5 mm;

the end surface area Q of the second noble metal chip 45 in the range of 0.12 to 0.65 $mm^2$;

the length B of the second noble metal chip 45 in the range of 0.5 to 1.2 mm;

the air pocket size L, which is the distance between the inner surface of the metal shell 10 and the outer surface of the insulator 20 on the reference plane 101, equal to or greater than 1.5 mm;

L/G, which is the ratio of the air pocket size L to the spark gap size G, equal to or greater than 1.25; and the insulation thickness T, which is the thickness of the insulator 20 on the reference plane, equal to or greater than 0.7 mm.

The dimensional ranges of the end surface area S and the length A have been respectively specified, as described above, thereby strengthening the electric field in the spark gap 50 of the spark plug S1.

Further, the dimensional ranges of the end surface area Q and the length B have also been respectively specified, as described above, thereby strengthening the electric field in the spark gap 50.

Through strengthening the electric field in the spark gap 50, the increase of required spark voltage of the spark plug S1 due to increase of the spark gap size G can be considerably suppressed in comparison with conventional spark plugs.

Furthermore, the dimensional ranges of the air pocket size L together with the ratio L/G, and the insulation thickness T have been respectively specified, as described above, so that generation of side sparks in the spark plug S1 can be effectively suppressed while securing the insulation performance (i.e., the withstand voltage) of the spark plug S1.

Accordingly, the spark plug S1 according to the present embodiment has a structure that prevents generation of side sparks in the spark plug S1, while securing the withstand voltage thereof, over a long service life.

In addition, the first noble metal chip 35 is preferably made of an Ir-based alloy including Ir in an amount of greater than 50 weight percent and at least one additive, which alloy has a melting point of greater than 2000 degrees Celsius.

Furthermore, at least one additive is preferably selected from Pt, Rh, Ni, W, Pd, Ru, Re, Al, $Al_2O_3$, Y, $Y_2O_3$.

Through specifying the material of the first noble metal chip 35 as described above, a long service life is secured for the first noble metal chip 35.

Moreover, the second noble metal chip 45 is preferably made of a Pt-based alloy including Pt in an amount of greater than 50 weight percent and at least one additive, which alloy has a melting point of greater than 1500 degrees Celsius.

Furthermore, at least one additive for the second noble metal chip 45 is preferably selected from Ir, Rh, Ni, W, Pd, Ru, Re.

Through specifying the material of the second noble metal chip 45 as described above, a long service life is also secured for the second noble metal chip 45.

Second Embodiment

The spark plug S1 according to the previous embodiment includes the metal shell 10 having the threaded portion 12 the outer diameter of which is in the range of 12 to 14 mm; in this embodiment, a spark plug S2, which includes a metal shell 10 having a threaded portion 12 with an outer diameter equal to or less than 10 mm, is provided.

It should be noted that, for the threaded portion 12 of the spark plug S2, the range of the outer diameter of equal to or less than 10 mm corresponds to that of equal to or less than M10 in accordance with JIS.

The spark plug S2 has a structure almost identical to the structure of the spark plug S1, and can also be described with reference to FIGS. 1 and 2. Accordingly, the differences between the structure of the spark plug S1 and that of the spark plug S2 are mainly described in the present embodiment.

The spark plug S2 has a smaller outer diameter of the threaded portion 12 than the spark plug S1. In other words, the spark plug S2 is more slenderized in comparison with the spark plug S1. Therefore, in the structure of the spark plug S2, parameters such as the air pocket size L and the insulation thickness T, cannot have the same dimensional ranges as in the structure of the spark plug S1 due to the dimensional constraints.

Therefore, the dimensional ranges of such parameters, which characterize the structure of the spark plug S2 according to the present embodiment, have been determined based on investigation results from inventors.

It should be noted that the investigation results to be shown below are particularly for the spark plug S2 where the outer diameter of the threaded portion 12 of the metal shell 10 is 10 mm; it has been, however, experimentally confirmed that the same tendency and similar results can be observed with the spark plugs S2 where the outer diameter is less than 10 mm.

First, the dimensional ranges of the end surface area S and the length A of the first noble metal chip 35 have been determined for the spark plug S2 such that S is in the range of 0.12 to 0.38 $mm^2$, and A is in the range of 0.8 to 1.5 mm.

Further, the dimensional ranges of the end surface area Q and the length B of the second noble metal chip 45 have been determined for the spark plug S2 such that Q is in the range of 0.12 to 0.65 $mm^2$, and B is in the range of 0.5 to 1.2 mm.

The above dimensional ranges of parameters S, A, Q, and B for the spark plug S2 are the same as those for the spark plug S1. Such dimensional ranges have been determined for strengthening the electric field in the spark gap 50 of the spark plug S2.

Secondly, the dimensional range of the air pocket size L has been determined for the spark plug S2 in connection with that of the spark gap size G.

As mentioned previously, the spark plug S2 has a smaller outer diameter of the threaded portion 12 of the metal shell 10 than the spark plug S1. Therefore, the spark plug S2 cannot have as large an air pocket size L as the spark plug S1. In other words, the air pocket size L in the structure of the spark plug S2 must be smaller than that in the structure of the spark plug S1.

Thus, to satisfy the requirement on the relationship between the air pocket size L and the spark gap size G, it has been considered to decrease the spark gap size G in proportion to the decrease of the air pocket size L; the requirement is specified in the previous embodiment such that L/G is equal to or greater than 1.25.

The upper limit of the spark gap size G is commonly equal to 1.0 mm in structures of general spark plugs, where a metal shell has a threaded portion with an outer diameter of equal to or less than 10 mm. Thus, the upper limit of 1.0 mm has been employed for the spark gap size G in this embodiment.

On the contrary, when the spark gap size G is exceedingly reduced, the space available for sparking becomes so small that it is easy for a misfire to occur. Specifically, it has been found experimentally that, when the spark gap size G is less than 0.4 mm, misfires occur easily.

Accordingly, in this embodiment, the range of the spark gap size G has been specified such that G is in the range of 0.4 to 1.0 mm.

Figure 7:
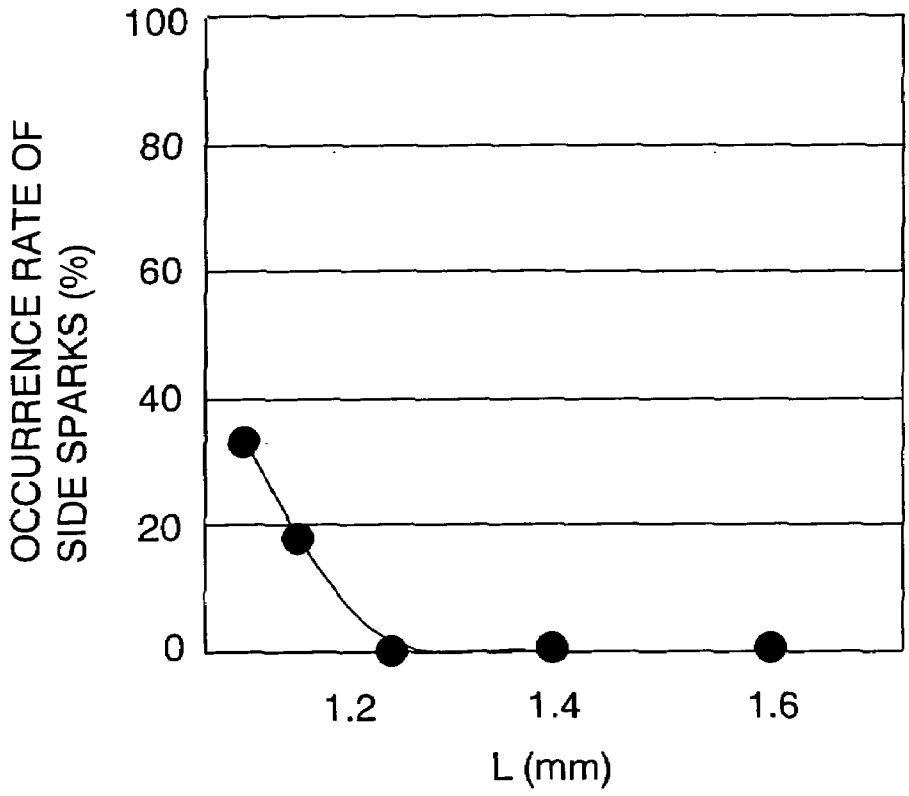
FIG. 7 is a graphical representation showing investigation results on the relationship between an air pocket size in a spark plug and the occurrence rate of "side sparks" in the spark plug in connection with a second embodiment of the invention.

FIG. 7 shows an investigation results on the relationship between the air pocket size L and the occurrence rate of side sparks. The investigation was conducted in the same manner as that investigation in the first embodiment the results of which are shown in FIG. 5; in the investigation, the engine tested had four cylinders and a capacity of 1800 cc, and the test was conducted under the idling condition where the engine speed is 800 rpm, and the water temperature is 50 degrees Celsius.

Spark plugs tested in the investigation had a structure in which the outer diameter of the threaded portion 12 is 10 mm; the end surface area S is 0.2 $mm^2$ (corresponding to an end surface diameter of 0.5 mm); the length A is 1.2 mm; the end surface area Q is 0.38 $mm^2$ (corresponding to an end surface diameter of 0.7 mm); the length B is 0.8 mm; the spark gap size G is 1.0 mm; and the insulation thickness T is 0.6 mm. In the investigation, the air pocket size L was varied to determine the resultant occurrence rate of side sparks. The occurrence rate of side sparks was counted in the same way as in that investigation the results of which are shown in FIG. 5.

It can be seen from FIG. 7 that, when the air pocket size L is equal to or greater than 1.2 mm, generation of side sparks in the spark plug is completely suppressed.

Finally, the effect of the insulation thickness T on the occurrence rate of dielectric breakdown of the spark plug S2 has been investigated.

Figure 8:
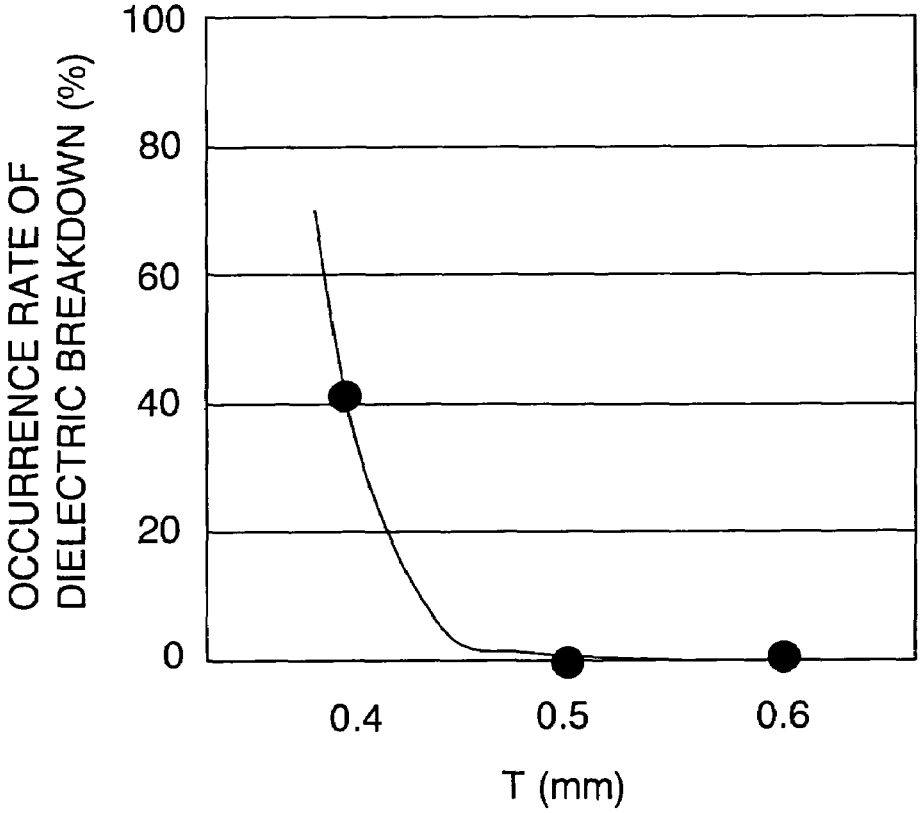
FIG. 8 is a graphical representation showing investigation results on the relationship between a thickness of an insulator of a spark plug and the occurrence rate of dielectric breakdown of the spark plug in connection with the second embodiment of the invention.

FIG. 8 shows the investigation results. The investigation was conducted in the same manner as that investigation in the first embodiment the results of which are shown in FIG. 6; in the investigation, the engine tested had four cylinders and a capacity of 1800 cc, and the test was conducted under conditions of idling to a full throttle acceleration of 1000 rpm.

Spark plugs tested in the investigation had a structure in which the outer diameter of the threaded portion 12 is 10 mm; the end surface area S is 0.2 $mm^2$; the protruding length A is 1.2 mm; the end surface area Q is 0.38 $mm^2$; the protruding length B is 0.6 mm; the spark gap size G is 1.0 mm; and the air pocket size L is 1.2 mm. In the investigation, the insulation thickness T was varied to determine the resultant occurrence rate of dielectric breakdown of the spark plug. The occurrence rate of dielectric breakdown of the spark plug was counted in the same way as in the above-mentioned investigation in the previous embodiment.

It can be seen from FIG. 8 that, when the insulation thickness T of the insulator 20 is equal to or greater than 0.5 mm, the withstand voltage of the spark plug is secured, thereby preventing dielectric breakdown thereof.

Moreover, structures of spark plugs, which have a metal shell having a threaded portion with an outer diameter of equal to or less than 10 mm, are generally subject to dimensional constraints including the sizes of electrodes, the spaces available for accommodating electrodes, and the disposition spaces. Due to such dimensional constraints, those spark plugs generally have an upper limit of the air pocket size L equal to 1.6 mm and an upper limit of the insulation thickness T equal to 0.8 mm.

Accordingly, in this embodiment, the dimensional ranges of the air pocket size L and the insulation thickness T have been specified for the spark plug S2 such that L is in the range of 1.2 to 1.6 mm, and T is in the range of 0.5 to 0.8 mm.

To sum up, the spark plug S2 according to the present embodiment, which includes the metal shell 10 having the threaded portion 12 with an outer diameter of equal to or less than 10 mm, has a structure characterized by the following parameters:

the end surface area S of the first noble metal chip 35 in the range of 0.12 to 0.38 $mm^2$;

the length A of the first noble metal chip 35 in the range of 0.8 to 1.5 mm;

the end surface area Q of the second noble metal chip 45 in the range of 0.12 to 0.65 $mm^2$;

the length B of the second noble metal chip 45 in the range of 0.5 to 1.2 mm;

the air pocket size L in the range of 1.2 to 1.6 mm;

the spark gap size G in the range of 0.4 to 1.0 mm; and the insulation thickness T in the range of 0.5 to 0.8 mm.

In the above structure, the parameters S, A, Q, and B have, respectively, the same dimensional ranges as in the structure of the spark plug S1 according to the previous embodiment, so that the electric field in the spark gap 50 of the spark plug S2 can be strengthened. Consequently, the increase of required spark voltage of the spark plug S2 due to increase of the spark gap size G can be considerably suppressed in comparison with conventional spark plugs.

Moreover, through specifying the dimensional range of the air pocket size L as described above, generation of side sparks in the spark plug S2 can be effectively suppressed under the dimensional constraints in the structure of the slenderized spark plug S2.

Further, through specifying the dimensional range of the spark gap size G as described above, misfires can be prevented in the slenderized spark plug S2, thereby enhancing the ignition performance of the spark plug S2.

Furthermore, through specifying the dimensional range of the insulation thickness T as described above, the insulation performance (i.e., the withstand voltage) of the spark plug S2 can be secured under the dimensional constraints in the structure of the slenderized spark plug S2.

Accordingly, the spark plug S2 according to the present embodiment has a structure that prevents generation of side sparks in the spark plug S2, while securing the withstand voltage thereof, over a long service life.

Third Embodiment

Figure 9:
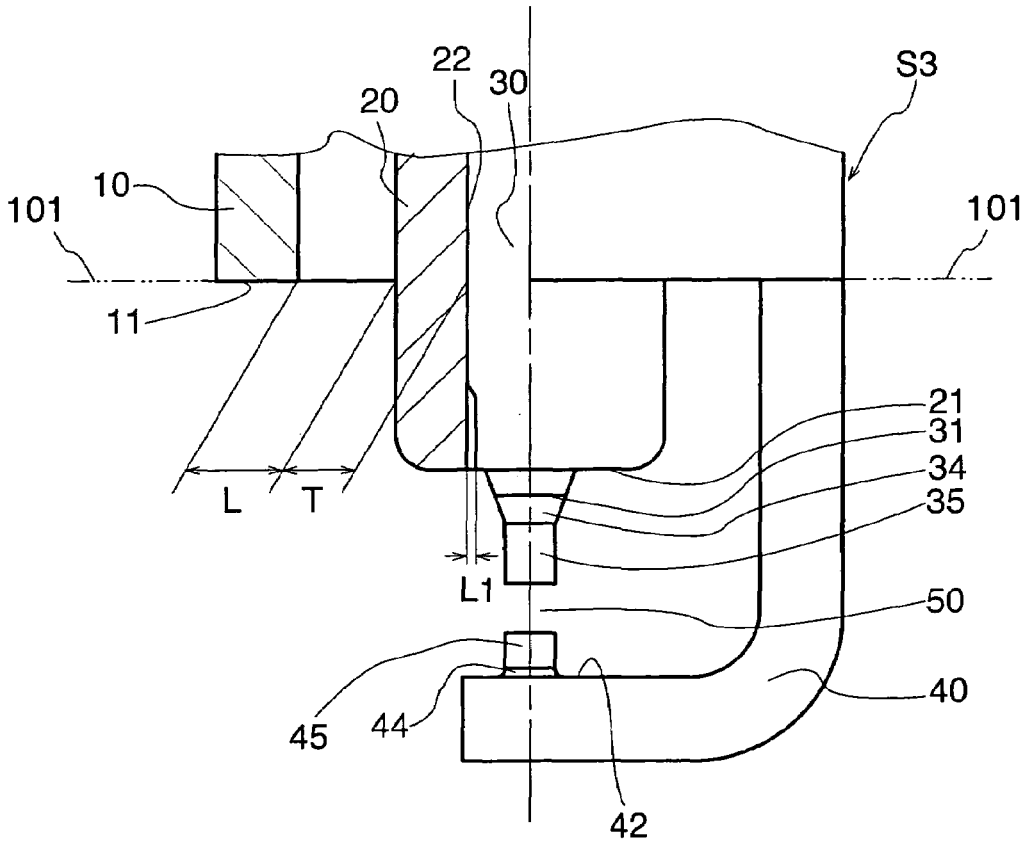
FIG. 9 is an enlarged partially cross-sectional side view showing a spark gap and the proximity thereof in a spark plug according to a third embodiment of the invention.

FIG. 9 shows a spark gap 50 and its proximity in a spark plug S3 according to a third embodiment of the present invention. This embodiment is a modification of the second embodiment of the invention; accordingly, the differences between the structure of the spark plug S3 and that of the spark plug S2 according to the second embodiment will be mainly described hereinafter.

The spark plug S3 includes a metal shell 10 that has a threaded portion 12 (not shown in FIG. 9) with an outer diameter of equal to or less than 10 mm. The spark plug S3 is characterized in that a clearance L1 shown in FIG. 9 is in the range of 0.1 to 0.3 mm; L1 is the clearance between an inner surface of an insulator 20 and an outer surface of a center electrode 30 on a plane which extends parallel to a reference plane 101 through an inner edge of an end 21 of the insulator 20.

Generally, in the structure of a spark plug such as the spark plug S2, the clearance L1 of equal to or less than 0.1 mm is applied to allow the center electrode 30 to be smoothly inserted into a center bore 22 of the insulator 20.

However, in this embodiment, the clearance L1 of the spark plug S3 has been increased to obtain an effect on suppressing generation of side sparks in the spark plug which can, otherwise, be obtained through increasing the air pocket size L. In addition, the clearance L1 can be increased, for example, by machining the center electrode 30.

The above-described range of the clearance L1 according to the present embodiment has been determined through an experimental investigation. The results of the investigation are shown in FIG. 10.

The investigation was conducted in the same manner as that investigation in the first embodiment the results of which are shown in FIG. 5; in the investigation, the engine tested had four cylinders and a capacity of 1800 cc, and the test was conducted under the idling condition where the engine speed is 800 rpm, and the water temperature is 50 degrees Celsius.

Spark plugs tested in the investigation had a structure in which the outer diameter of the threaded portion 12 is 10 mm; the end surface area S of the first noble meal chip 35 is 0.2 $mm^2$ (corresponding to an end surface diameter of 0.5 mm); the length A of the first noble metal chip 35 is 1.2 mm; the end surface area Q of the second noble metal chip 45 is 0.38 $mm^2$ (corresponding to an end surface diameter of 0.7 mm); the length B of the second noble metal chip 45 is 0.8 mm; the insulation thickness T is 0.6 mm; and the spark gap size G is 0.9 mm. The air pocket size L was varied to determine the resultant occurrence rate of side sparks in two different cases; in one case, the clearance L1 was kept constant at 0.1 m, while in the other case, that was kept constant at 0.2 m. The occurrence rate of side sparks was counted in the same way as in the investigation the results of which are shown in FIG. 5.

Figure 10:
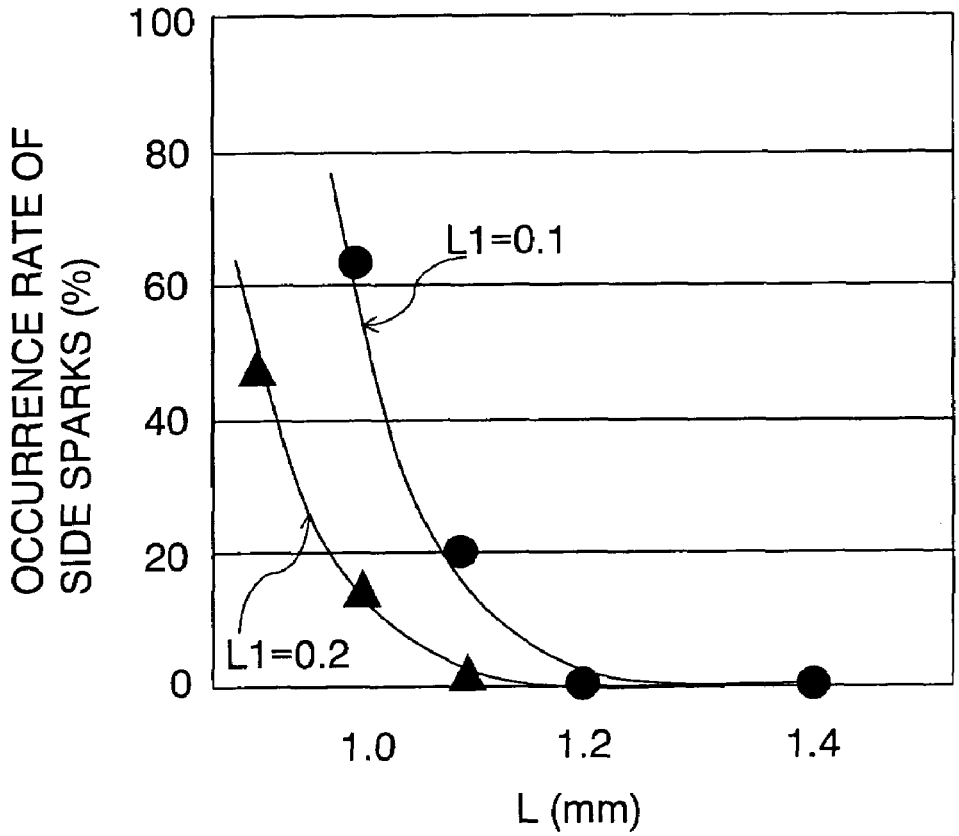
FIG. 10 is a graphical representation showing investigation results on the effect of the size of a clearance in a spark plug on the occurrence rate of "side sparks" in the spark plug in connection with the third embodiment of the invention.

It can be seen from FIG. 10 that, in the case where the clearance L1 is 0.2 mm, generation of side sparks is effectively suppressed with respect to smaller air pocket size L in comparison with a case where the clearance L1 is 0.1 mm.

In other words, comparing to conventional spark plugs with the clearance L1 of equal to or less than 0.1 mm, the capability of the spark plug S3 in suppressing generation of side sparks therein has been enhanced through increasing the clearance L1.

Furthermore, in light of the results shown in FIG. 10, the clearance L1 in the spark plug S3 is preferably equal to or greater than 0.2 mm.

On the contrary, when the clearance L1 is too large, it becomes difficult to transfer heat away from the insulator 20 to the center electrode 30, so that the temperature of the end 21 of the insulator 20 increases exceedingly, thereby resulting in a pre-ignition. Therefore, the clearance L1 of the spark plug S3 is preferably equal to or less than 0.3 mm.

Accordingly, in this embodiment, the dimensional range of the clearance L1 in the spark plug S3 has been specified such that L1 is greater than 0.1 mm, and equal to or less than 0.3 mm.

Through specifying the dimensional range of the clearance L1, the spark plug S3 according to the present embodiment has been imparted further enhanced capability in suppressing generation of side sparks therein in comparison with the spark plug S2 according to the second embodiment.

Fourth Embodiment

Figure 11:
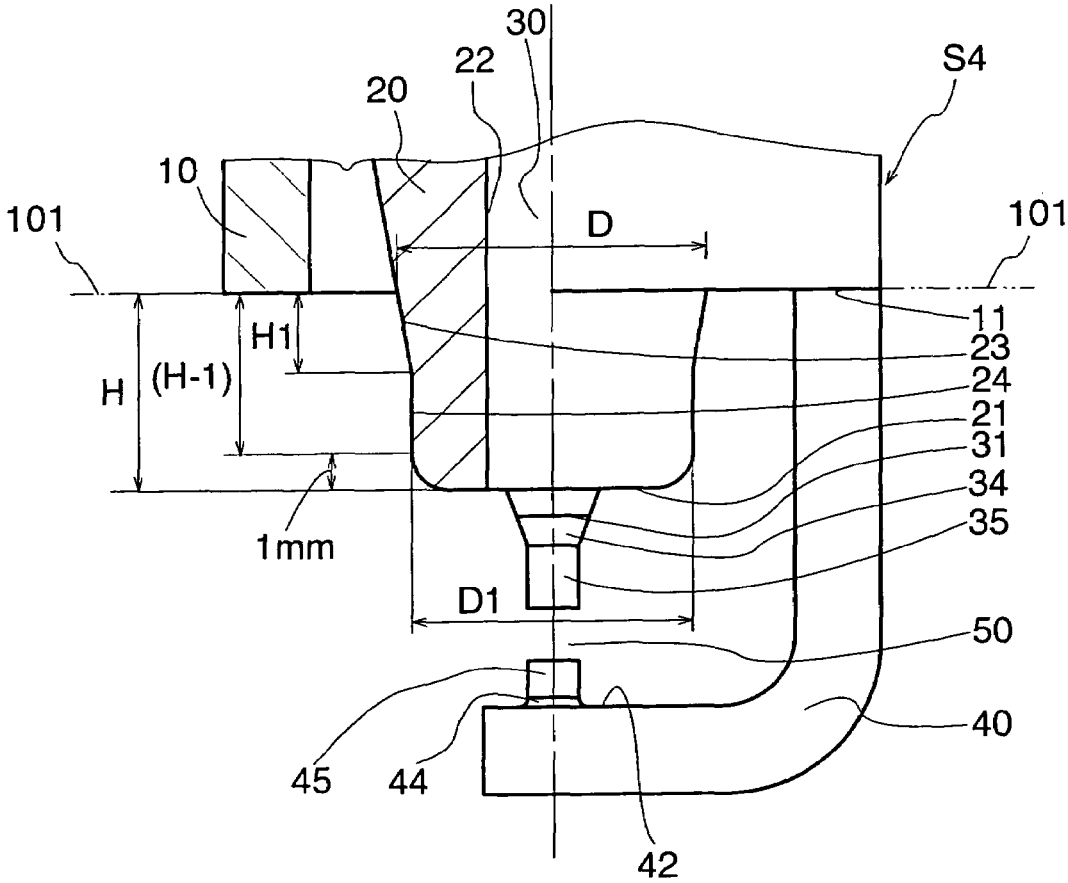
FIG. 11 is an enlarged partially cross-sectional side view showing a spark gap and the proximity thereof in a spark plug according to a fourth embodiment of the invention.

FIG. 11 shows a spark gap 50 and its proximity in a spark plug S4 according to a fourth embodiment of the present invention. This embodiment is a modification of the second embodiment of the invention, and accordingly, the differences between the structure of the spark plug S4 and that of the spark plug S2 according to the second embodiment will be mainly described hereinafter.

For a slenderized spark plug, such as the spark plug S2 which includes the metal shell 10 having the threaded portion 12 with an outer diameter of equal to or less than 10 mm, the insulator 20 thereof is correspondingly slenderized, thus raising concern about the thermal strength of the insulator.

In this embodiment, the spark plug S4, which includes a metal shell 10 having a threaded portion 12 (not shown in FIG. 11) with an outer diameter of equal to or less than 10 mm, is provided as a result of an experimental investigation on the thermal strength of an insulator 20 thereof.

As shown in FIG. 11, the tubular insulator 20 of the spark plug S4 has an outer surface which includes a frusto-conical section 23 and a cylindrical small diameter section 24. The small diameter section 24 has a first end spaced 1 mm from an end 21 of the insulator 20 and a second end spaced further away from the end 21 of the insulator 20 than the first end. The frusto-conical section 23 has an interface which coincides with the second end of the small diameter section 24. The frusto-conical section 23 tapers toward the interface thereof.

The parameters involved in the investigation are also shown in FIG. 11, wherein:

H is a distance in the longitudinal direction of the insulator 20 from an end 11 of the metal shell 10 to the end 21 of the insulator 20, H being greater than 1 mm;

H1 is a distance in the longitudinal direction of the insulator 20 between the end 11 of the metal shell 10 and the interface of the frusto-conical section of the insulator 20;

D1 is a diameter of the frusto-conical section of the insulator 20 at the interface thereof; and D is a diameter of the frusto-conical section of the insulator 20 on a reference plane 101, D being greater than D1.

Additionally, a taper degree of the frusto-conical section 23 represented by (D−D1)/H1 has been employed in the investigation (referred to as taper degree (D−D1)/H1 hereinafter).

The taper degree (D−D1)/H1 is a parameter which has a great effect on the thermal strength of the insulator 20.

Specifically, when an internal combustion engine experiences an acceleration from idling to full throttle or a deceleration from full throttle to idling, a rapid heating or a rapid cooling of the engine will occur. In such cases, a great difference of temperature rises between an inner and an outer surface of the insulator of a spark plug used for the engine, resulting in crack in the insulator due to heat stress.

In order to reduce such differences of temperature between the inner and outer surfaces of the insulator, it is preferred for the insulator to have a small diameter portion close to the end thereof. However, at the same time, a greater thickness of the insulator is more advantageous to enhancing the insulation performance of the spark plug.

The spark plug S4, which has the small diameter section 24 and the frusto-conical section 23, has been considered to solve the above trade-off. Nevertheless, for the spark plug S4, the frusto-conical section 23 induces an increase of heat stress, so that cracks can occur from the interface of the frusto-conical section 23 (i.e., the second end of the small diameter section 24).

Additionally, it has been experimentally found that, for the spark plug S4, the difference of temperature between the inner and outer surfaces of the insulator 20 is small in the portion of the insulator 20 from the end 21 to the position longitudinally spaced 1 mm from the end 21.

Therefore, the thermal strength of the insulator 20 is influenced mainly by the shapes of the frusto-conical section 23 and the small diameter section 24. Particularly, the taper degree (D−D1)/H1 is critical to the thermal strength of the insulator 20; as the taper degree (D−D1)/H1 increases, the thermal strength of the insulator 20 decreases.

In order to determine the permissible range, that is, the upper limit of the taper degree (D−D1)/H1, the investigation was conducted through thermal shock testing.

Spark plugs tested in the investigation had a structure in which the outer diameter of the threaded portion 12 is 10 mm; the end surface area S is 0.2 $mm^2$; the length A is 1.2 mm; the end surface area Q is 0.38 $mm^2$; the length B is 0.6 mm; the spark gap size G is 1.0 mm; the air pocket size L is 1.2 mm; and the insulation thickness T is 0.6 mm.

Moreover, in the investigation, the distance H was kept at 2.5 mm; the diameter D of the insulator 20 was kept at 3.7 mm; and the small diameter D1 of the insulator 20 was kept at 3.1 mm. With respect to the distance H1, three different sizes of 0.3 mm, 0.4 mm, and 0.6 mm were used. It is easy to understand that, for given diameters D and D1, the taper degree (D−D1)/H1 is inversely proportional to the distance H1.

The thermal shock test was conducted by immersing the spark plugs with room temperature into molten tin (Sn) in a bath, and then determining whether a crack has occurred in those spark plugs due to the difference of temperature between the room temperature and the molten tin temperature. The temperature of the molten tin was varied in the investigation so as to provide various differences of temperatures.

Figure 12:
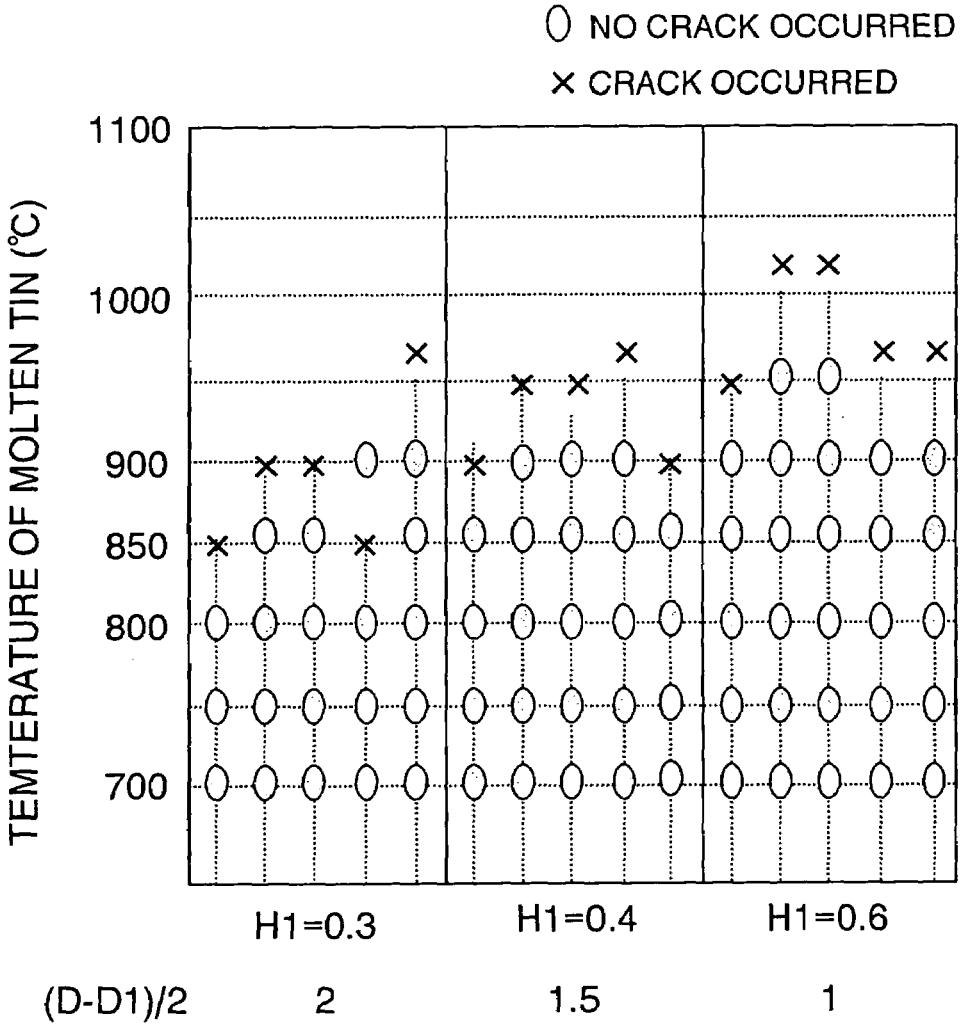
FIG. 12 is a view showing the results of a thermal shock test for an insulator of a spark plug in connection with the fourth embodiment of the invention.

FIG. 12 shows the investigation results. As shown in FIG. 12, three different groups of spark plugs were tested at each given temperature of the molten tin; each group included respectively five spark plugs with same distance H1 selected from 0.3 mm, 0.4 mm, and 0.6 mm, and spark plugs belong to different groups had different distance H1.

In FIG. 12, the symbol "○" indicates spark plugs where a crack has occurred, while the symbol "x" indicates spark plugs where no crack has occurred. Additionally, three different taper degrees (D−D1)/H1 are shown under each corresponding distance H1.

It should be noted that, in such a thermal shock test, when no crack has occurred in the insulator of a spark plug at the molten tin temperature of above 800 degrees Celsius, it is considered that the spark plug can be used in an internal combustion engine.

It can be seen from FIG. 12 that, when the distance H1 is equal to or greater than 0.3 mm, no crack has occurred in the insulators 20 of all the tested spark plugs at the temperature of 800 degrees Celsius. The distance H1 of 0.3 mm corresponds to the taper degree (D−D1)/H1 of 2.

It can also be seen from FIG. 12 that, when the distance H1 is equal to or greater than 0.4 mm, in other words, the taper degree (D−D1)/H1 is equal to or less than 1.5, no crack has occurred in the insulators 20 of all the tested spark plugs at the temperature of 850 degrees Celsius.

Accordingly, in this embodiment, the range of the taper degree (D−D1)/H1 has been specified for the spark plug S4 such that (D−D1)/H1 is less than 2, preferably equal to or less than 1.5.

To sum up, the spark plug S4 according to the present embodiment, which includes the metal shell 10 having the threaded portion 12 with an outer diameter of equal to or less than 10 mm, has a structure where the taper degree (D−D1)/H1 is less than 2, preferably equal to or less than 1.5.

Through specifying the range of the taper degree (D−D1)/H1 as described above, the thermal strength of the insulator 20 is secured, thereby preventing occurrence of cracks in the insulator 20 while securing the insulation performance of the spark plug S4.

Variation of Fourth Embodiment

The spark plug S4 according to the previous embodiment has a structure where the frusto-conical section 23 is provided on the outer surface of the insulator 20; as a variation of the spark plug S4, a spark plug S4' is provided which has a structure where a frusto-conical section 23' is provided on an inner surface forming a center bore 22 in an insulator 20.

Figure 13:
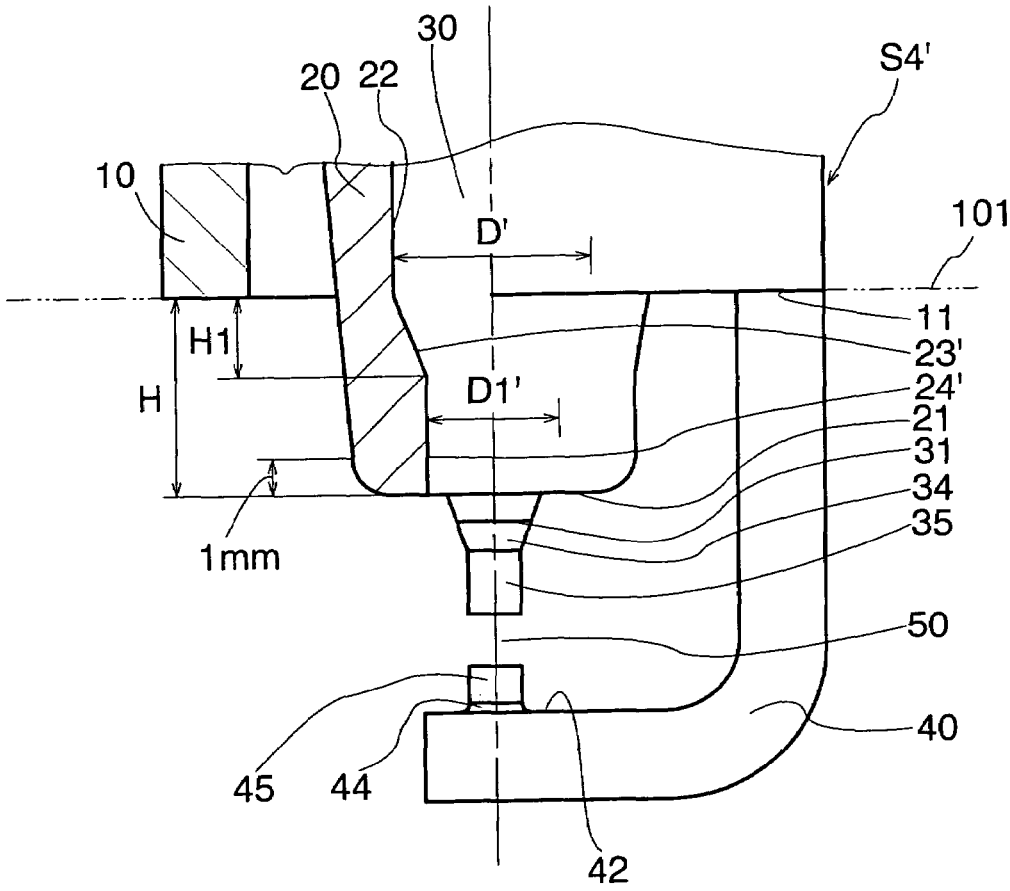
FIG. 13 is an enlarged partially cross-sectional side view showing a spark gap and the proximity thereof in a spark plug according to a modification of the fourth embodiment of the invention.

FIG. 13 shows a spark gap 50 and its proximity in the spark plug S4'. The inner surface of the insulator 20 includes, as shown in FIG. 13, a frusto-conical section 23' and a cylindrical small diameter section 24'. The small diameter section 24' has a first end which coincides with an inner edge of the end 21 of the insulator, and a second end spaced from the inner edge of the end 21. The frusto-conical section 23' has an interface which coincides with the second end of the small diameter section 23'. The frusto-conical section 23' tapers toward the interface thereof.

The following parameters are also shown in FIG. 13, wherein:

H is a distance in the longitudinal direction of the insulator 20 from an end 11 of the metal shell 10 to the end 21 of the insulator 20, H being greater than 1 mm;

H1 is a distance in the longitudinal direction of the insulator 20 between the end 11 of the metal shell 10 and the interface of the frusto-conical section 23' of the insulator 20;

D1' is a diameter of the frusto-conical section 23' of the insulator 20 at the interface thereof; and D' is a diameter of the frusto-conical section 23' of the insulator 20 on a reference plane 101, D' being greater than D1'.

Additionally, a taper degree of the frusto-conical section 23' is represented by (D'−D1')/H1 (referred to as taper degree (D'−D1')/H1 hereinafter).

The spark plug S4', which includes a metal shell 10 having a threaded portion 12 (not shown in FIG. 13) with an outer diameter of equal to or less than 10 mm, has a structure where the taper degree (D'−D1')/H1 is less than 2, preferably equal to or less than 1.5.

The above range of the taper degree (D'−D1')/H1 has been determined through an investigation similar to that in the fourth embodiment of the invention. As a result, the thermal strength of the insulator 20 of the spark plug S4' is secured, thereby preventing occurrence of crack in the insulator 20 while securing the insulation performance of the spark plug S4'.

Fifth Embodiment

In the embodiments that have so far been described, the dimensional rages of the end surface areas Q were specified such that Q was in the range of 0.12 to 0.65 $mm^2$. In other words, the range of 0.4 to 0.9 mm was specified for the diameters of the second end surfaces of the second noble metal chips 45.

In this embodiment, a spark plug S5 is provided which has a structure where the end surface area Q is in the range of 0.12 to 0.35 $mm^2$. Such a range of the end surface area Q is corresponding to a range of 0.4 to 0.65 mm for the diameter of the second end surface of a second noble metal chip 45 of the spark plug S5. More specifically, the second noble metal chip 45 of the spark plug S5 is further slenderized in comparison with the spark plugs provided in the previous embodiments.

It has been noted in the first embodiment that a 0.2 mm increment of the spark gap size G approximately corresponds to the increment of the spark gap size G due to spark wear after an actual mileage of 200,000 km. The investigation in the first embodiment, the results of which are shown in FIGS. 4A and 4B, was conducted keeping the increment of the spark gap size G at 0.2 mm.

Accordingly, a long service life corresponding to the actual mileage of 200,000 km can be secured for those spark plugs provided in the previous embodiments.

However, it has been considered that a longer service life corresponding to an actual mileage of 300,000 km will be required for future spark plugs.

Thus, an investigation was conducted through FEM analysis to determine the range of the end surface area Q necessary for suppressing increase of the required spark voltage even when the spark gap size G increased by 0.3 mm.

Figure 14:
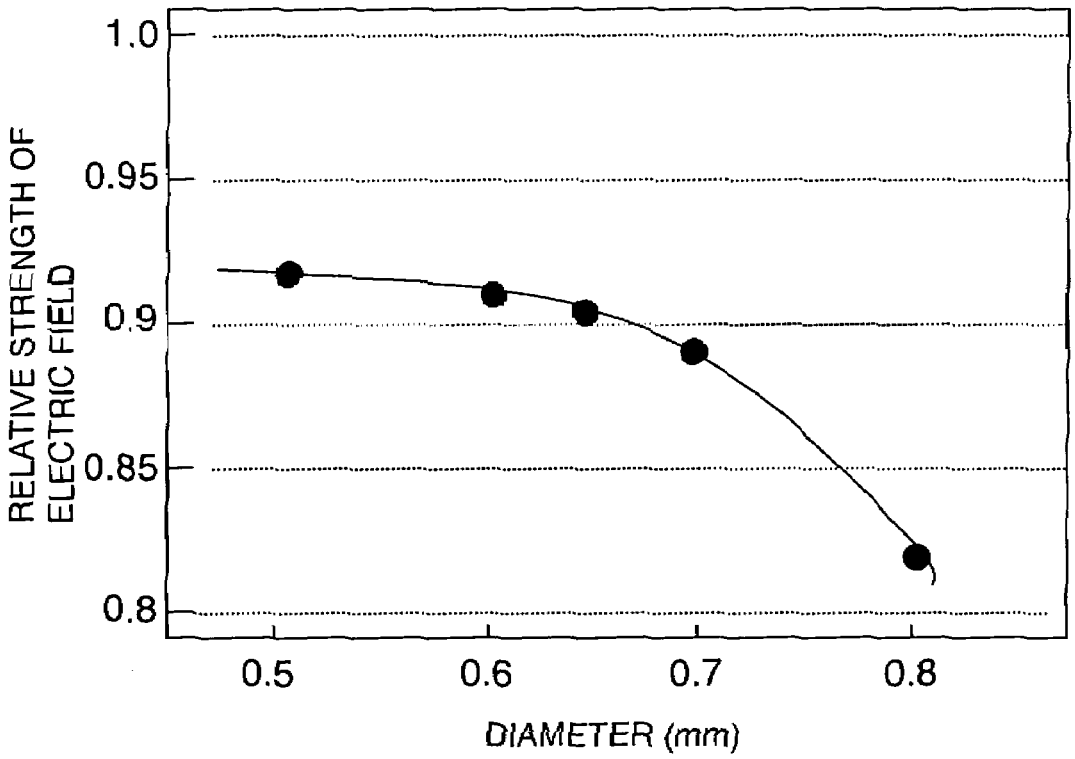
FIG. 14 is a graphical representation showing investigation results on the relationship between the diameter of an end surface of a noble metal chip on a ground electrode of a spark plug and the relative strength of the electric field in a spark gap of the spark plug in connection with a fifth embodiment of the invention.

The investigation results are shown in FIG. 14. It should be noted that the second noble metal chips 45 tested in the investigation had a cylindrical shape and the sizes of the second end surfaces of the tested second noble metal chips 45 are represented by diameter rather than area in FIG. 14. Moreover, the relative strength of electric field in FIG. 14 has the same definition as in FIG. 3.

Spark plugs tested in the investigation had a structure almost identical to that of the spark plug S1, and can also be described with reference to FIGS. 1 and 2. In the structures of the tested spark plugs, the end surface area S was 0.2 $mm^2$; the length A was 1.2 mm; the length B was 0.8 mm; and the spark gap size G was 1.3 mm (i.e., increased by 0.3 mm with respect to the reference spark gap size G). In the investigation, the diameter of the second end surface of the second noble metal chip 45 was varied to determine the resultant relative strength of the electric field.

It can be seen from FIG. 14 that, when the diameter of the second end surface of the second noble metal chip 45 is equal to or less than 0.65 mm, in other words, the end surface Q is equal to or less than 0.35 $mm^2$, the relative strength of the electric field is kept above 0.9 mm regardless of the 0.3 mm increment of the spark gap size G, thereby effectively suppressing the increase of required spark voltage due to any increase of the spark gap size G.

Further, as in the first embodiment, the lower limit of the end surface area Q for the spark plug S5 has been determined such that Q is equal to or greater than 0.12 $mm^2$.

Accordingly, the above-described range of 0.12 to 0.35 $mm^2$ has been determined for the end surface area Q in the present embodiment.

To sum up, the spark plug S5 according to the present embodiment has a structure where the second noble metal chip 45 is a further slenderized one. Specifically, the range of the end surface area Q has been specified such that Q is in the range of 0.12 to 0.35 $mm^2$. As a result, for the spark plug S5, the increase of required spark voltage due to an increased spark gap size G can be suppressed, thereby preventing generation of side sparks therein.

Accordingly, the spark plug S5 according to the present embodiment has a structure that prevents generation of side sparks in the spark plug, while securing the withstand voltage of the spark plug, over a longer service life, for example corresponding to the mileage of 300,000 km.

While the above particular embodiments of the invention have been shown and described, it will be understood by those who practice the invention and those skilled in the art that various modifications, changes, and improvements may be made to the invention without departing from the spirit of the disclosed concept. Such modifications, changes, and improvements within the skill of the art are intended to be covered by the appended claims.

What is claimed is:

1. A spark plug comprising:

a hollow metal shell having a first end and a second end opposed to the first end, said metal shell also having a threaded portion on an outer periphery thereof and an inner chamber opening at the first end, the threaded portion having an outer diameter in a range of 12 to 14 mm;

an insulator having a length with a first end and a second end opposed to the first end of said insulator, said insulator also having a bore formed therein, said insulator being fixed in the inner chamber of said metal shell such that the first end of said insulator protrudes from the first end of said metal shell;

a center electrode secured in the bore of said insulator, said center electrode having an end protruding from the first end of said insulator;

a ground electrode having a side surface, said ground electrode being joined to the first end of said metal shell such that the side surface of said ground electrode is in opposed relationship with the end of said center electrode;

a first noble metal chip having a first end joined to the end of said center electrode, and a second end facing the side surface of said ground electrode; and a second noble metal chip having a first end joined to the side surface of said ground electrode and a second end facing the second end of said first noble metal chip, the second end of said second noble metal chip being spaced from the second end of said first noble metal chip so as to form a spark gap therebetween;

wherein a surface area of the second end of said first noble metal chip is in a range of 0.12 to 0.38 $mm^2$, inclusive;

a length of said first noble metal chip from the end of said center electrode to the second end of said first noble metal chip is in a range of 0.8 to 1.5 mm, inclusive;

a surface area of the second end of said second noble metal chip is in a range of 0.12 to 0.65 $mm^2$, inclusive;

a length of said second noble metal chip from the side surface of said ground electrode to the second end of said second noble metal chip is in a range of 0.5 to 1.2 mm, inclusive;

a distance L between an inner surface of said metal shell defining the inner chamber and an outer surface of said insulator on a reference plane which extends perpendicular to the length of said insulator through an inner edge of the first end of said metal shell, is equal to or greater than 1.5 mm;

a ratio L/G of the distance L to a space G of the spark gap between the second ends of the first and second noble metal chips is equal to or greater than 1.25; and a thickness of the insulator on the reference plane is equal to or greater than 0.7 mm.

2. The spark plug as set forth in claim 1, wherein the surface area of the second end of said second noble metal chip is in a range of 0.12 to 0.35 $mm^2$, inclusive.

3. The spark plug as set forth in claim 1, wherein the first end of said first noble metal chip is joined to the end of said center electrode by laser welding, and the length of said first noble metal chip is equal to a distance between the first and second ends of said first noble metal chip plus a distance between the end of said center electrode and the first end of said first noble metal chip through a weld layer, the weld layer being formed between said center electrode and said first noble metal chip through the laser welding.

4. The spark plug as set forth in claim 1, wherein the first end of said second noble metal chip is joined to the side surface of said ground electrode by laser welding, and the length of said second noble metal chip is equal to a distance between the first and second ends of said second noble metal chip plus a distance between the side surface of said ground electrode and the first end of said second noble metal chip through a weld layer, the weld layer being formed between said ground electrode and said second noble metal chip through the laser welding.

5. The spark plug as set forth in claim 1, wherein said first noble metal chip is made of an Ir-based alloy including Ir in an amount of greater than 50 weight percent and at least one additive, the Ir-based alloy having a melting point of greater than 2000 degrees Celsius.

6. The spark plug as set forth in claim 5, wherein the at least one additive is selected from Pt, Rh, Ni, W, Pd, Ru, Re, Al, $Al_2O_3$, Y, $Y_2O_3$.

7. The spark plug as set forth in claim 1, wherein said second noble metal chip is made of a Pt-based alloy including Pt in an amount of greater than 50 weight percent and at least one additive, the Pt-based alloy having a melting point of greater than 1500 degrees Celsius.

8. The spark plug as set forth in claim 7, wherein the at least one additive is selected from Ir, Rh, Ni, W, Pd, Ru, Re.

9. A spark plug comprising:

a hollow metal shell having a first end and a second end opposed to the first end, said metal shell also having a threaded portion on an outer periphery thereof and an inner chamber opening at the first end, the threaded portion having an outer diameter equal to or less than 10 mm;

an insulator having a length with a first end and a second end opposed to the first end of said insulator, said insulator also having a bore formed therein, said insulator being fixed in the inner chamber of said metal shell such that the first end of said insulator protrudes from the first end of said metal shell;

a center electrode secured in the bore of said insulator, said center electrode having an end protruding from the first end of said insulator;

a ground electrode having a side surface, said ground electrode being joined to the first end of said metal shell such that the side surface of said ground electrode is in opposed relationship with the end of said center electrode;

a first noble metal chip having a first end-joined to the end of center electrode, and a second end facing the side surface of said ground electrode; and a second noble metal chip having a first end joined to the side surface of said ground electrode and a second end facing the second end of said first noble metal chip, the second end of said second noble metal chip being spaced from the second end of said first noble metal chip so as to form a spark gap therebetween;

wherein a surface area of the second end of said first noble metal chip is in a range of 0.12 to 0.38 $mm^2$, inclusive;

a length of said first noble metal chip from the end of said center electrode to the second end of said first noble metal chip is in a range of 0.8 to 1.5 mm, inclusive;

a surface area of the second end of said second noble metal chip is in a range of 0.12 to 0.65 $mm^2$, inclusive;

a length of said second noble metal chip from the side surface of said ground electrode to the second end of said second noble metal chip is in a range of 0.5 to 1.2 mm, inclusive;

a distance between an inner surface of said metal shell defining the inner chamber and an outer surface of said insulator on a reference plane which extends perpendicular to the length of said insulator through an inner edge of the first end of said metal shell, is in a range of 1.2 to 1.6 mm, inclusive;

a space of the spark gap between the second ends of the first and second noble metal chips is in a range of 0.4 to 1.0 mm, inclusive; and a thickness of the insulator on the reference plane is in a range of 0.5 to 0.8 mm, inclusive.

10. The spark plug as set forth in claim 9, wherein a clearance between an inner surface of said insulator defining the bore of the same and an outer surface of said center electrode on a plane which extends parallel to the reference plane through an inner edge of the first end of said insulator, is greater than 0.1 mm, and equal to or less than 0.3 mm.

11. The spark plug as set forth in claim 9, wherein the outer surface of said insulator includes:

a small diameter section having a first end spaced 1 mm from the first end of said insulator and a second end spaced further away from the first end of said insulator than the first end thereof; and a frusto-conical section having an interface which coincides with the second end of the small diameter section, the frusto-conical section tapering toward the interface thereof;

wherein a taper degree of the frusto-conical section of said insulator represented by (D−D1)/H1 is less than 2.0, where H1 is a distance in a direction of the length of said insulator between the first end of said metal shell and the interface of the frusto-conical section of said insulator;

D1 is a diameter of the frusto-conical section of said insulator at the interface thereof; and D is a diameter of the frusto-conical section of said insulator on the reference plane, D being greater than D1.

12. The spark plug as set forth in claim 11, wherein the taper degree of the frusto-conical section of said insulator represented by (D−D1)/H1 is equal to or less than 1.5.

13. The spark plug as set forth in claim 9, wherein said insulator has an inner surface defining the bore thereof, the inner surface of said insulator includes:

a small diameter section having a first end which coincides with an inner edge of the first end of said insulator, and a second end spaced from the first end of said insulator; and a frusto-conical section having an interface which coincides with the second end of the small diameter section, the frusto-conical section tapering toward the interface thereof;

wherein a taper degree of the frusto-conical section of said insulator represented by (D'−D1')/H1 is less than 2.0, where H1 is a distance in a direction of the length of said insulator between the first end of said metal shell and the interface of the frusto-conical section of said insulator;

D1' is a diameter of the frusto-conical section of said insulator at the interface thereof; and D' is a diameter of the frusto-conical section of said insulator on the reference plane, D' being greater than D1'.

14. The spark plug as set forth in claim 13, wherein the taper degree of the frusto-conical section of said insulator represented by (D'−D1')/H1 is equal to or less than 1.5.

15. The spark plug as set forth in claim 9, wherein the surface area of the second end of said second noble metal chip is in a range of 0.12 to 0.35 $mm^2$, inclusive.

16. The spark plug as set forth in claim 9, wherein the first end of said first noble metal chip is joined to the end of said center electrode by laser welding, and the length of said first noble metal chip is equal to a distance between the first and second ends of said first noble metal chip plus a distance between the end of said center electrode and the first end of said first noble metal chip through a weld layer, the weld layer being formed between said center electrode and said first noble metal chip through the laser welding.

17. The spark plug as set forth in claim 9, wherein the first end of said second noble metal chip is joined to the side surface of said ground electrode by laser welding, and the length of said second noble metal chip is equal to a distance between the first and second ends of said second noble metal chip plus a distance between the side surface of said ground electrode and the first end of said second noble metal chip through a weld layer, the weld layer being formed between said ground electrode and said second noble metal chip through the laser welding.

18. The spark plug as set forth in claim 9, wherein said first noble metal chip is made of an Ir-based alloy including Ir in an amount of greater than 50 weight percent and at least one additive, the Ir-based alloy having a melting point of greater than 2000 degrees Celsius.

19. The spark plug as set forth in claim 18, wherein the at least one additive is selected from Pt, Rh, Ni, W, Pd, Ru, Re, Al, $Al_2O_3$, Y, $Y_2O_3$.

20. The spark plug as set forth in claim 9, wherein said second noble metal chip is made of a Pt-based alloy including Pt in an amount of greater than 50 weight percent and at least one additive, the Pt-based alloy having a melting point of greater than 1500 degrees Celsius.

21. The spark plug as set forth in claim 20, wherein the at least one additive is selected from Ir, Rh, Ni, W, Pd, Ru, Re.

* * * * *